US007316636B1

(12) United States Patent
Hinds et al.

(10) Patent No.: US 7,316,636 B1
(45) **Date of Patent: *Jan. 8, 2008**

(54) IMPINGED RETENTION EXERCISE ASSEMBLY

(76) Inventors: Robert Sylvester Hinds, 1803 Regent St., Madison, WI (US) 53705; Loyd William Bonneville, 1213 Amsterdam Ave., Madison, WI (US) 53716

( * ) Notice: Subject to any disclaimer, the term of this patent is extended or adjusted under 35 U.S.C. 154(b) by 0 days.

This patent is subject to a terminal disclaimer.

(21) Appl. No.: 11/479,777

(22) Filed: Jun. 30, 2006

Related U.S. Application Data

(63) Continuation-in-part of application No. 10/844,217, filed on May 12, 2004, now Pat. No. 7,147,592.

(51) Int. Cl.
*A63B 21/02* (2006.01)

(52) U.S. Cl. ..... 482/126; 482/44

(58) Field of Classification Search ..... 482/126, 482/121–130, 44–49, 907, 79; D21/662, D21/665, 682, 698
See application file for complete search history.

(56) References Cited

U.S. PATENT DOCUMENTS

| | | | | |
|---|---|---|---|---|
| 2,035,010 | A | 3/1936 | Rawlings | |
| 2,509,810 | A | 5/1950 | Core, Jr. | |
| 3,565,451 | A | 2/1971 | Giambazi | |
| 3,880,443 | A | 4/1975 | Tobin | |
| 4,218,057 | A | 8/1980 | Wilson | |
| 5,141,223 | A | 8/1992 | Block | |
| 5,433,688 | A | 7/1995 | Davies | |
| 5,505,677 | A | 4/1996 | Hinds | |
| 5,549,532 | A | 8/1996 | Kropp | |
| 5,647,827 | A | 7/1997 | Gutkowski et al. | |
| 5,894,631 | A | 4/1999 | Chiu | |
| 6,398,698 | B1 | 6/2002 | Hinds | |
| 7,044,894 | B1 | 5/2006 | Smith | |
| 7,147,592 | B2 * | 12/2006 | Hinds et al. | 482/126 |

* cited by examiner

*Primary Examiner*—Lori Amerson
(74) *Attorney, Agent, or Firm*—Loyd W. Bonneville

(57) ABSTRACT

Three types of exercise grips provide for pivot-anchoring of an impinging body within them so that the impinger heads engage stretchable or non-stretchable exercise media extending upward through their tunnels. The first is a handgrip, the second, an exercise spool used in the manner of cross-country skiing or vigorous walking and the third, an ankle crescent-shaped grip for lateral repetition exercises of the legs. An impinger is caused to swing down to press against exercise media emerging from the grip's tunnel to provide a reliable of connection. Proper anchoring of the impinger within the grip assures its continuing presence to make adjustments and avoids its loss or misplacement. The handgrip permits of anchoring either within the body's interior or at its exterior, in which case, the impinger stem is caused to extend through a window cut therein.

14 Claims, 15 Drawing Sheets

FIG 4
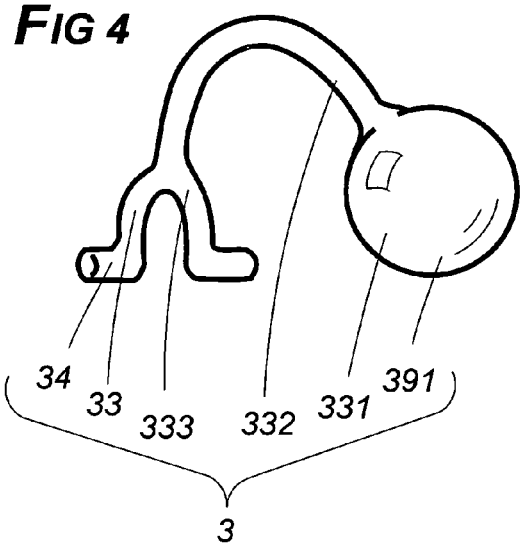
FIG 5
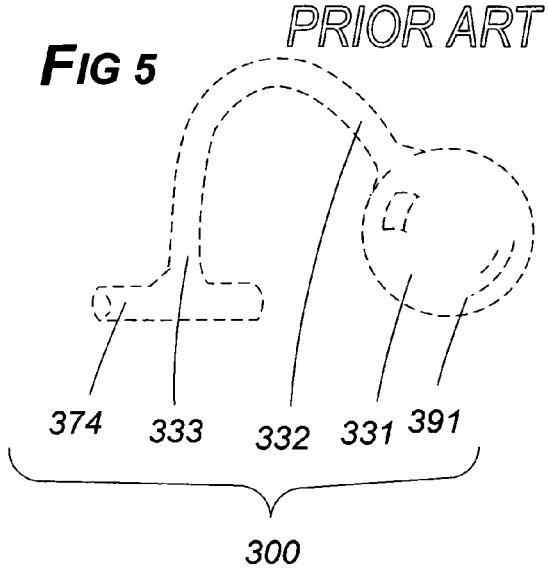
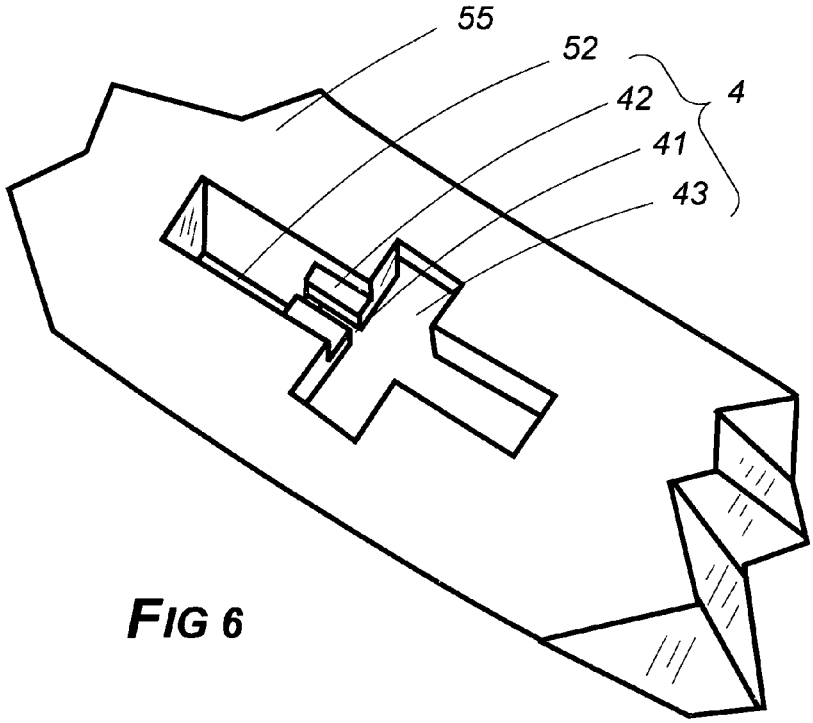
FIG 6

FIG 20
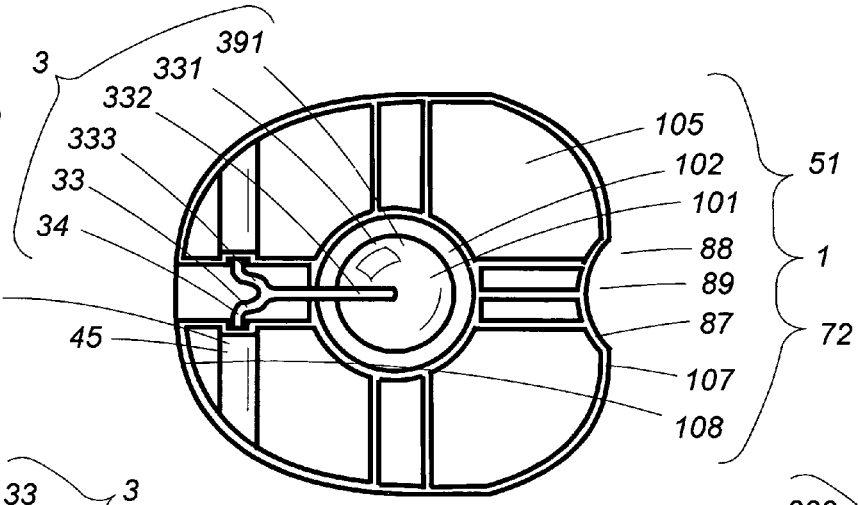
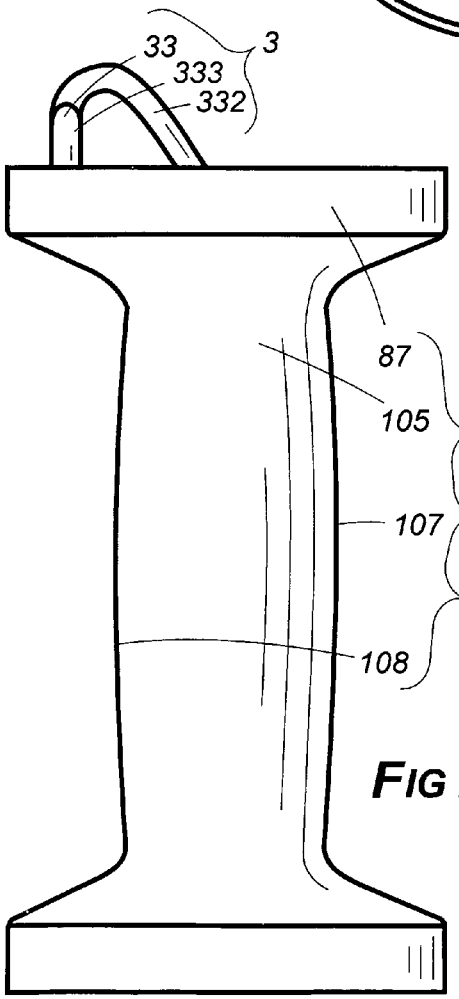
FIG 21
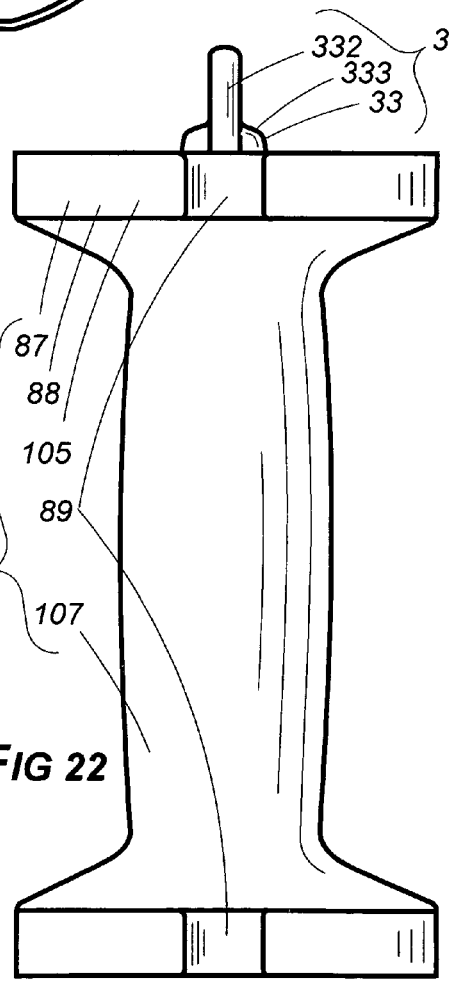
FIG 22

FIG 23
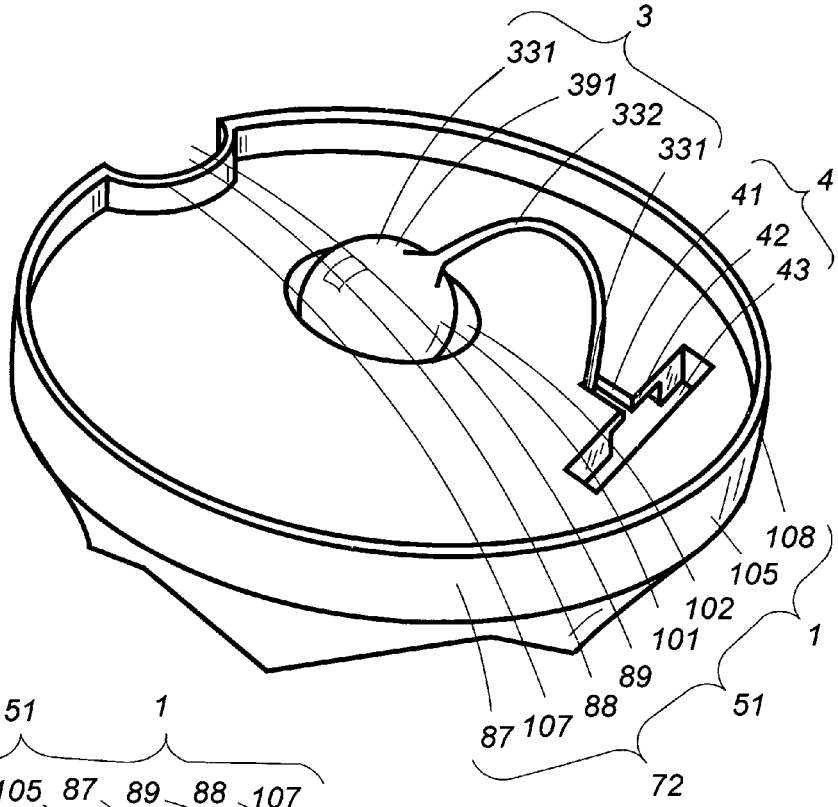
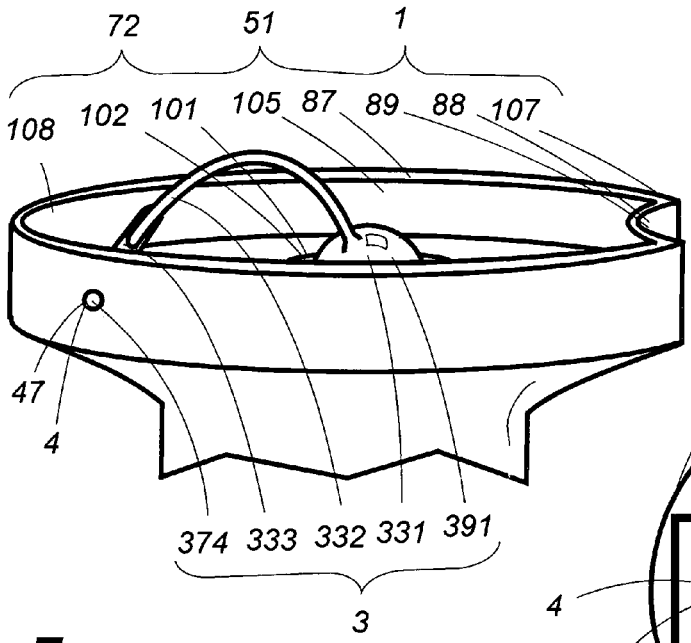
FIG 24
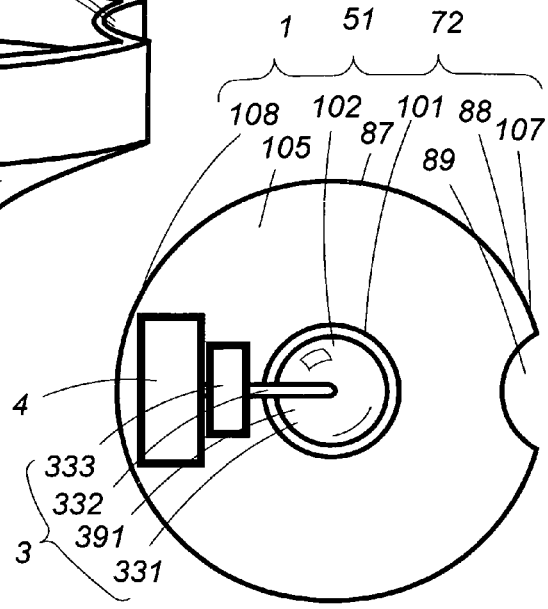
FIG 25

IMPINGED RETENTION EXERCISE ASSEMBLY

CROSS-REFERENCE TO RELATED APPLICATIONS

This instrument, filed under 37 CFR 1.53(*b*) and 1.78 invoking the provisions of 35 U.S.C. 120, is a Continuation in Part of presently application Ser. No. 10/844,217 entitled "Retained Impinger Handgrip Assembly", filed May 12, 2004 now U.S. Pat. No. 7,147,592.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

1. Field of the Invention

Exercise equipment

2. Description of Related Art, Following Throughout this Section

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term window's tether access opening (54) might be used in one instance but in another, if meaning is otherwise clear from context, expression might be shortened to tether access opening (54) or merely opening (54). Any of those forms is intended to convey the same meaning.

The term attach or fasten or any of their forms when so used means that the juncture is of a more or less permanent nature, such as might be accomplished by nails, screws, welds or adhesives. Thus it is stated herein that the connection of the impinger's head (331) to its stem (332) is one of attachment. A connection in which an object is easily removed from another is described by the word emplace, as where it is stated herein that the impinger's head (331) is emplaced within the handgrip tunnel's nest (102). A connection in which two objects, although not attached could be separated only with considerable difficulty is referred to herein as one of rigid emplacement. The fastening of the impinger's pinchable tether (33) within the handgrip's transverse peg sockets (46) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that a prior art tunneled stirrup handgrip (100) is modified in certain particulars to comprise an impinger anchoring handgrip (71), meaning that the latter is in fact the former. The term comprise may also be characterized by what might be considered one-way equivalency, as when it is stated herein that a T-shaped configuration for the retention channel (41) preferably comprises its (41) tether pivot-anchoring means (4), meaning that in the given instance, the T-shaped channel (41) is itself (41) the tether pivot-anchoring means (4). This use of the word has a generic sense to it. That is, a T-shaped channel (41) will always be tether pivot-anchoring means (4) but tether pivot-anchoring means (4) may be a T-shaped channel (41) in one case but something else in another. However, the word comprise may also be used to describe a feature which is part of the structure or composition of a given object. Thus, an exterior sector anchoring handgrip (51) is said to preferably comprise, among other things, a tethering window (52) as a component thereof (51). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of an exercise grip (1) or other object in the manner in which it would be typically oriented when held if the anchored tension point were situated at the bottom and as presented in the drawings. Thus, the tethering window (52) is described as passing through some portion of the handgrip's (71, 51) upward extensions; the effect of gravity upon the impinger (3) is explained in terms of the handgrip's tunnel (101) being disposed downward; and the tether (333) of a traditional impinger (300) as extending outward from the lower end of the cord tunnel (101). It is also stated that perimeter flanges (87) be preferably disposed at the spool grip's (72) upper and lower extremes. It is intended that orientational references to the object be equally understood regardless of any theoretical disposition of it such as, for example, if it were held upside down.

By definition herein, the term "in communication with" concerning the interrelationship between two objects means that nothing is disposed to separate or provide a barrier or other obstruction of the like between them. Where, for example, channels and openings are considered to be in communication with one another, what is meant is that the cavities disposed by each are coextensive with one another much in the way a river and the reservoir of water supplying it are in communication with each other. And, where it is, thus, said as herein that the retention channel (41) is in communication with the tethering window (52), what is meant is that the two structures (41, 52) extend directly into one another without structural impediment. The phrase communicative alignment is addressed ante.

Wherever practicable, words and phrases are presented in adjective form with reference to a given object to describe either its function or its essence. Thus, a retention configured impinger (300) has been known merely to designate one (300) configured for retention.

The term reeve, or any of various forms thereof—enreevement, for example—is occasionally employed herein. It is stated, for example, that in certain embodiments, the impinger stem (332) and tether (333) may operably be reeved through the handgrip's window (52). The phrase "within its body" as used to denote the disposition of tether pivot-anchoring means (4) with respect to any of several types of exercise grip (1) is not intended in the strictly literal sense but rather, to be interpreted as a shorthand expression of convenience to include the notion that the means (4) may also be disposed within housing connected directly to the grip's (1) body in a manner that is either integral with it (1) or otherwise effectually part of it (1), thereby distinguishing such disposition from the two-piece or loosely connected arrangements ordinarily known.

The word spool, used herein to describe a particular sort of exercise grip (72), adopts one of two dictionary meanings, addressing an ordinarily stationary object formed as a tunneled cylinder, optionally comprising flanges (87) at its (72) upper and lower extremes; and rejects an alternative meaning indicating a rotable or spinning body, as might be used with certain machinery.

In some cases, the same word expressed as a noun is also used for a verb. Thus, it is stated, for example, that the exercise grip (1) comprises a cord tunnel (101), the opening through which the exercise media member (200) passes. Yet, it is also understood that in order to accommodate the member (200), the exercise grip (1) must be tunneled. The propriety of this divergent use of the term is established by the dictionary.

In that respect, certain other words may also occasionally be coined herein to simplify discussion by interchanging noun, verb or adjective or by modifying certain words. It takes little imagination to understand, for example, that the coined word impinger (3, 300), often itself the center of discussion herein, has been recognized as identifying an object which is capable of impingement upon another object. The word rotable is another example of coining use denoting an axial, possibly spinning, behavior rather than some other sort of circular motion which might be addressed by the more cumbersome word rotatable.

References to the general exercise media member (200) are meant to include the specific stretchable exercise cord (201); stretchable exercise strap (202); stretchable exercise sheet (203); rope (204), whether hemp or other; fabric strapping (205); and solid flexible cord (206), such as plastic and the like. The term cord tunnel (101), used as a matter of convenience herein, is not intended to limit application to the reeving of stretchable exercise cord (201) therethrough but to extend also to that of stretchable exercise strap (202), stretchable exercise sheet (203) as well as the non-stretchable media. The same is true of the generic term exercise grip (1), which is designated herein to incorporate as species various embodiments of exercise objects including the impinger anchoring handgrip (71), the exercise spool grip (72) and the ankle crescent grip (73).

Because of the feasibility of incorporating into the assembly addressed herein either a prior art impinger (300) or the improved one provided for herein (3) comprising a departure therefrom, for the sake of convenience and to avoid unnecessary cluttering, reference numbers are occasionally recited in the compound sense—for example, (3, 300) with reference to the impingers themselves; or (34, 374) with reference to specific types of impinger tethers. As a convenient convention to clarify the distinction, the prior art varieties or components are identified to have three digits.

The tunneled stirrup handgrip (100) and impinger (300) combination have, for a time now, become established in the prior art. Traditional plugged stretchable hollow exercise cords (201)—those in which a plug is fitted within the cord's (201) end after insertion through a handgrip's cord tunnel (101)—demonstrate considerable wearing of the cord (201) because of its (201) contact against the upper edge of the handgrip's cord tunnel (101). It was to that end the impinger (300) was developed. A length of exercise media member (200), usually a stretchable—or "elastic" as sometimes expressed—is passed through the tunnel (101) of a traditional prior art handgrip (100). Its (200) length is adjusted by pushing more or less of it (200) through the opening (101). Having now been selectively positioned for length, an impinger (300) is then pulled against it (200) into the tunnel's upper portion—or nest (102), as it is designated, so that it (200) becomes rigidly emplaced therein (102). By reason of the combination's use, an operator may quickly change the effectual length of the media member (200) or interchange it (200) with another.

In addition to the tunnel (101), the handgrip (100) comprised upward extending prongs and, at the uppermost extremes thereof, a handhold (103) configured to be either fixed or rotable.

The exterior sector (105) of the traditional handgrip (100) is that portion thereof (100) outside that into which the operator's hand—or, in some instances, his or her foot—extends. That latter portion of the grip (100)—inside—is herein designated its interior sector (106).

The impinger has always comprised a head (331), a stem (332) and a tether (333). The head (331) has been attached to one end of the stem (332), the tether (333), to the other. It is the head (331) which trapped or snugged against the media member (200) during impingement. The tether (333) at the opposing end performed no impingement function but has been intended merely to secure the impinger (300) to the handgrip (100). Since the impinger (300) has been stationed at the handgrip tunnel (101) with the head at the top thereof (101) at the grip's interior sector (106) and the tether (333) at the bottom thereof (101) at the exterior sector (105), the connecting stem (332) has necessarily resided within it (101).

Tether tensioning assemblies were provided in U.S. Pat. No. 2,035,010 issued to Rawlings; U.S. Pat. No. 5,647,827 issued to Gutkowski, et al; U.S. Pat. No. 5,141,223 issued to Block; U.S. Pat. No. 5,433,688 issued to Davies; and U.S. Pat. No. 7,044,894 B1 issued to Smith. All but the latter of these involved self-tethered stretchable media (200) manipulated by a given paired hand-held device or handgrip (100). The Smith assembly employs paired stretchable cord members (201) as a preferable choice to form a sling-like supportive exercise loop about one's arms while walking.

Hand-held dumbbell and ski handle arrangements for walking, skiing and the like were offered in U.S. Pat. No. 2,509,810 issued to Core, Jr.; U.S. Pat. No. 3,565,451 issued to Giambazi, U.S. Pat. No. 3,880,443 issued to Tobin; and U.S. Pat. No. 4,218,057 issued to Wilson. The first of these presented small paired hand-held dumbbells ostensibly pursuing the same exercise function as that provided by stretchable cord (201), re-awakening the now old dispute between weight lifting advocates vis-a-vis those for stretchable cord resistance. Giambazi and Tobin dealt with ski pole handle configurations relevant, of course, to any hand-held skiing or walking exercise member. The last of those, the Wilson patent, comprised paired weighted handgrips specifically designed for jogging exercise.

Schemes for handgrip impinger (300) to exercise media (200), primarily stretchable exercise cord (201), have taken various forms as shown in U.S. Pat. No. 5,505,677 issued to Hinds, also the applicant herein; U.S. Pat. No. 5,549,532 issued to Kropp; U.S. Pat. No. 5,894,631 issued to Chiu; and U.S. Pat. No. 6,398,698 issued to Hinds. The impinging heads themselves (331) have been offered in various shapes, some more suitable than others in fulfilling their (333) purpose. In the latter Hinds patent, several configurations were provided including spherical (391), lozenge (392), truncated sphere (393), ovate (394) and bean shape (395). One of the embodiments of the impinger's tether (333)— that is, the anchoring portion—comprised transverse extensions (373), a widely adopted configuration.

During media member (200) impingement, the stem (332) crowded it (200) to some extent interfering with impingement. When not in use, the impinger (300) was subject to possible loss or misplacement because the same characteristics which permitted its (300) emplacement could also be responsible for its (300) dislodgement. Worse, a phenomenon known as torque stress was often observed in which the impinger's head (331) twisted as the exercise cord (201) was pulled in one direction or another. Because the stem (332) was not anchored, there was no way to avoid the problem.

Even should a suitable anchoring solution be conceived, however, some additional change to the impinger (300) must be made to avoid the hindrance to impinger head's (331) emplacement within the impingement nest (102) caused by its (331) side-to-side swaying at the end of a stem (332) to date having been made slender enough to be seated within the cord tunnel (101).

It is now recognized that what is needed is an impinger (300) whose stem (332) could be disposed other than through the cord tunnel (101) so that it (332) not only could be disposed for more dependable association with an exercise grip (1)—separated from it (1) only with difficulty—but more importantly, might be successfully strengthened in rigidity to address both the torque stress and the side-to-side swaying, features of axial stability.

The problem of stretchable cord (201) abrasion against the upper edge of the handgrip's tunnel (101) still remains despite the use of the traditional impinger (300). A new arrangement permitting removal of the stem (332) from the tunnel (101) would circumvent those difficulties. Even the scheme of wrapping the stem (332) around one of the handgrip's (100) prongs and then clamped in some fashion, although meritworthy, have not been completely satisfactory. A connection of that sort can still become loosened and thereby hinder exercise.

Exercise operators have also experienced difficulty in having stretchable exercise sheet (203) comprise the media member (200) used with the handgrip (100) because it (203) cannot be easily reeved or pushed through the cord tunnel (101). This is particularly important in matters of rehabilitation. It would be helpful if impingers (300), designed rather small to avoid obstructive interference during use, could be provided to allow widening of the tunnel (101). Those steps would provide a beneficial solution to that problem.

It would also be useful if impingement could be imposed against a greater class of exercise media members (200). Impingers (300) which work well with stretchable exercise cord (201) have been observed to fail miserably with non-stretchable media such as rope (204), fabric strapping (205) or solid cord (206)—say, the one-eighth to one-quarter inch diameter sort sometimes preferred in certain exercises. A more or less universal impinger (3) configured to provide the capability of retaining well any media flexible enough to become impinged-even the non-stretchable materials—would be welcome.

The historical development went far, as least to a point, in addressing important needs and objectives related to exercise handgrip (100) use. It is now time, however, to address needs and objectives emanating from the fruits of those past efforts.

SUMMARY OF THE INVENTION

The invention, stemming from needs most generally felt in connection with the tunneled handgrip (100) of prior art, finds expression in three manifestations presented herein, leading to conjecture that there must, undoubtedly, be even more. Although usually expressed in the singular, the variant exercise members are intended for employment in pairs. With reference to the first of these, the handgrip (100) is modified in a manner to successfully accommodate either the familiar retention configured impinger (300) or the pinch-tethered impinger (3), a derivation therefrom (300) to comprise what is herein designated an impinger anchoring handgrip (71). The second comprises a similarly anchored exercise spool grip (72) employed in pairs most usually in the manner one would use ski poles for cross-country skiing. The last of these three, featuring those same novelties, provides a stance-strengthening ankle grip (73) for lateral extension repetitions of the legs. Together, the three (71-73) comprise a family of reliable exercise grips (1) which, though somewhat diverse in their respective applications, share strongly related functionality.

As with the other members of the family, the improved handgrip (71) incorporates or firmly anchors the tether (33, 333) securely, disposing the impinger's stem (332) at a site outside of the handgrip tunnel (101) and stiffens it (332) to axially stabilize the impinger's head (331) and facilitate its (331) emplacement within the cord tunnel's impingement nest (102). The stabilization feature avoids stress torque and the side-to-side stem (332) swaying propensities otherwise present.

To that end, in the most preferred handgrip (71) embodiments, a tethering window (52) with a tether access opening (54) therein is disposed in one of the upwardly extending prongs thereof (71) and transverse peg sockets (46) or peg apertures (47), within which (46, 47) impinger tethers (333) are rigidly emplaced, are disposed at its exterior sector (105), preferably within an ensconcing hollow (55).

The other two grips (1)—the exercise spool (72) and ankle variety (73)—also adopt exterior sectored (105) anchoring, albeit without any equivalent for the handgrip's tethering window (52). In a less preferred arrangement for the handgrip (7), the window (52) is similarly absent with anchoring disposed at its interior sector (106).

In some embodiments, a retention channel (41)—or perhaps, a retention tunnel (45)—is present. The channel (41) comprises a stem slotted roof (42) which entraps the impinger's tether (333) but allows the stem (332) and tether (333) to move freely along the length thereof (41).

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A heavily framed outline of a portion of the drawing is representative of a number of specific variations of the more generic feature it identifies. A planular cross-section portrays objects as they appear in a given cross-sectional plane disposed within the object's interior so that portions thereof behind or farther back from the plane are not shown. A medial cross-section is a single planular cross-section disposed at the object's mid-point.

FIGS. 4 and 5 respectively illustrate the pinch-tethered impinger (3) and that (300) comprising the rod-shaped extension (374), the latter, again, a product of the prior art. Given appropriately disposed peg sockets or apertures (46, 47, respectively), as the case requires, the tethers (33, 333) of both (3, 300) can be observed to comprise snap-in anchoring capabilities.

FIGS. 6-8 are cut-away depictions of the ensconcing hollow (55) in embodiments in which the handgrip's tether pivot-anchoring means (4) comprises a retention channel (41) disposed at the handgrip's exterior sector (105). A stem slotted roof (42), serving to trap the tether (33, 333) in retention, overlies the channel (41). The window (52) in these embodiments is formed without a tether access opening (54). Such an opening (43) is instead disposed within the newly added retention channel (41). In this arrangement, the snap-fitting of the pegs or rod-like tether members (34, 374) through the access opening (43) rigidly emplaces it (34, 374) within the channel (41) at the exterior sector (105). Although the channel (41) and window (52) of FIG. 6 are in communication with one another (41, 52), those of FIGS. 7 and 8 are not. They (41, 52) are instead shown to be slightly separated. FIG. 8, comprising a T-shape for the tether access opening (43), illustrates the tether's (33, 333) disposition during use.

In FIG. 15 is shown an ovate head (394) impinged against an exercise media member (200) comprising fabric strapping (205). In FIG. 16, a lozenge shaped head (392) impinges against a media member of rope (204); in FIG. 17, truncated sphere (393) against solid cord (206); and in FIG. 18, bean shaped (395) against stretchable exercise strap (202).

FIGS. 20-22 portray various views of the foregoing embodiment of the spool grip (72), revealing its (72) radial asymmetry, for reasons addressed ante, face-to-reverse side in FIG. 21 vis-a-vis side-to-side in FIG. 22. A retention tunnel (45) is shown to provide the tether pivot-anchoring means (4).

FIGS. 23 and 24 comprise additional types of exercise spool grip (72) tether pivot-anchoring means (4), a retention channel (41) in the former and transverse peg apertures (47) in the latter. FIG. 25 shows that any sort of tether (333), as well as pivot-anchoring means therefor (4) may be substituted without loss of novelty.

FIGS. 30 and 31 illustrate the use of the first of the two featured spool grip embodiments (72) and FIGS. 32 and 33, the second. In FIGS. 30 and 32, the spools (72) are shown emplaced without an exercise media member (200) upon the floor or other underlying surface, awaiting pushup exercise use addressed ante. FIGS. 31 and 33 depict similar exercise use wherein exercise media members (200) are run toward an exercise tensioning anchor, ante.

DESCRIPTION OF THE PREFERRED EMBODIMENT

Figure 1:
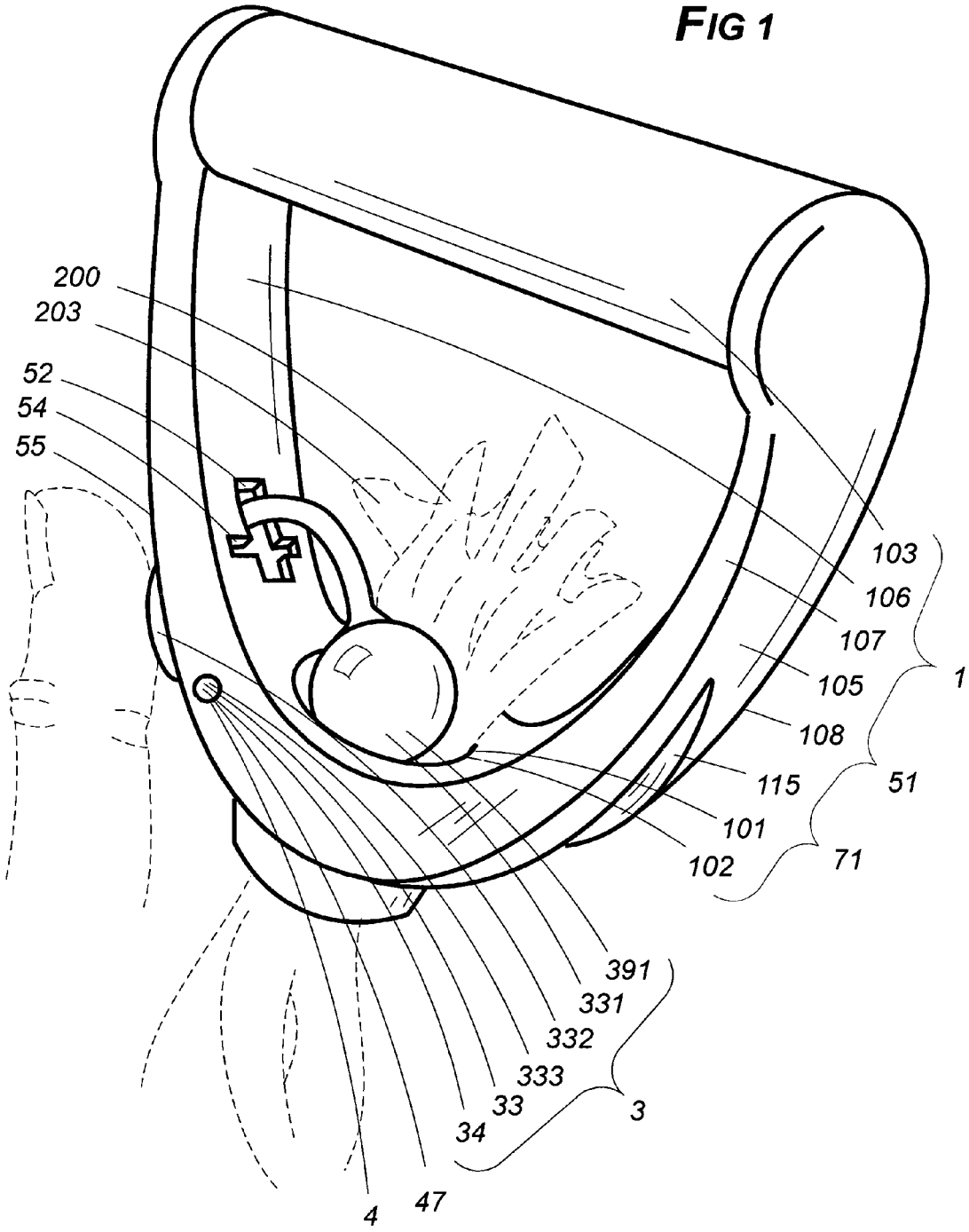
FIGS. 1 and 2 represent an embodiment of the handgrip (71) assembly in perspective illustrating in FIG. 1 the manner in which the operator's thumb accomplishes an impinger's (3) engagement in of a stretchable exercise media (200). The media (200) is shown in that drawing to comprise a sheet (203) and, in FIG. 2, a stretchable exercise cord (201). Although the tether (333) is mostly hidden from view in the first of these renderings, the latter confirms that the impinger (3) is the proposed pinch tethered configuration (3) which is disclosed and not the familiar one (300) comprising the traditional rod-shaped tether (374) of prior art. The handgrip's tether pivot-anchoring means (4) is shown to comprise opposing transverse peg apertures (47)—merely a hole penetrating the body of the grip (71), beginning at its face (107) and exiting at its reverse side (108). The tether access opening (54) is also disposed in this preferred handgrip (71) configuration to pass completely through its (71) body but in this case, from its interior sector (106) to an ensconcing hollow (55) at its exterior sector (105).
Figure 2:
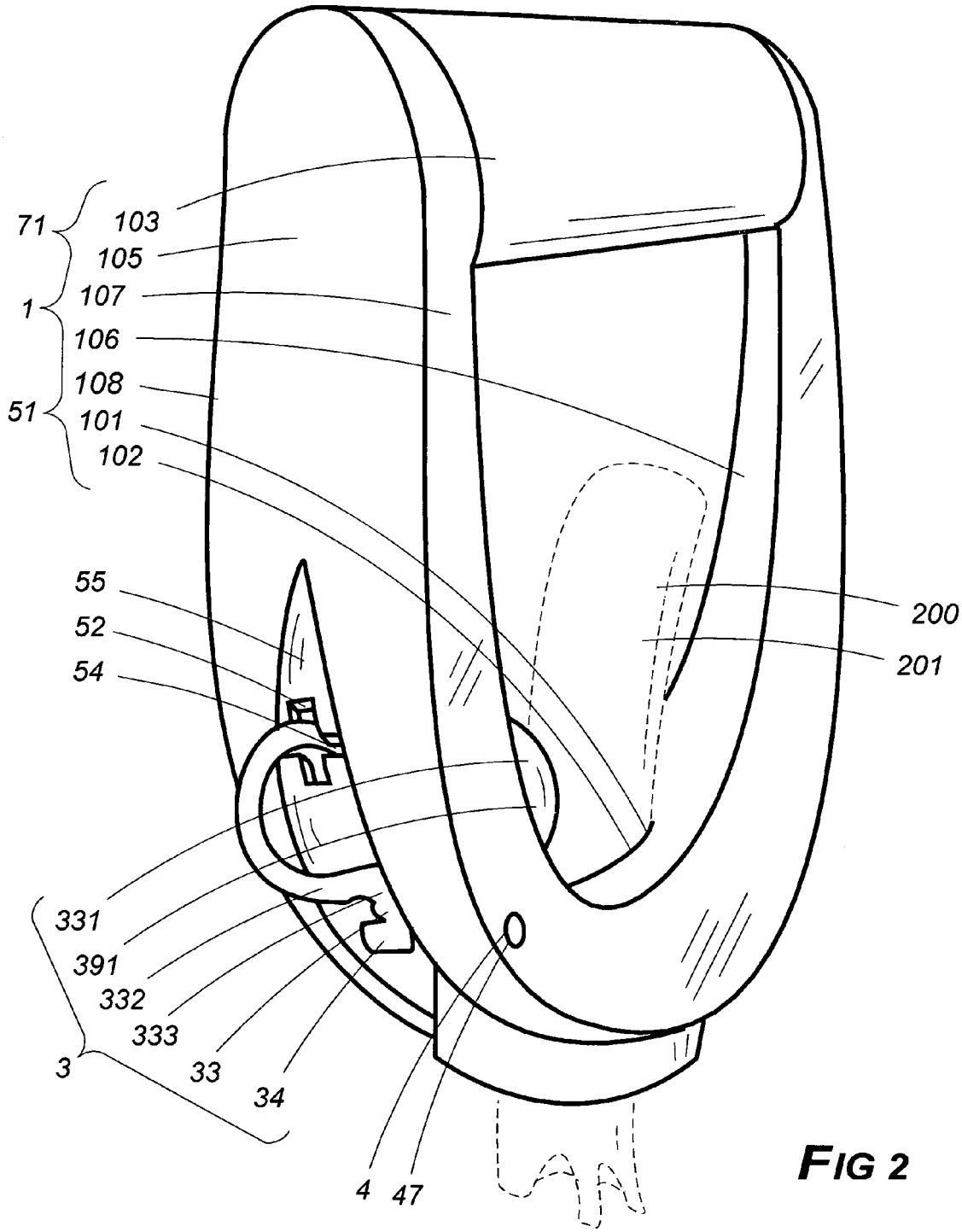
Figure 3:
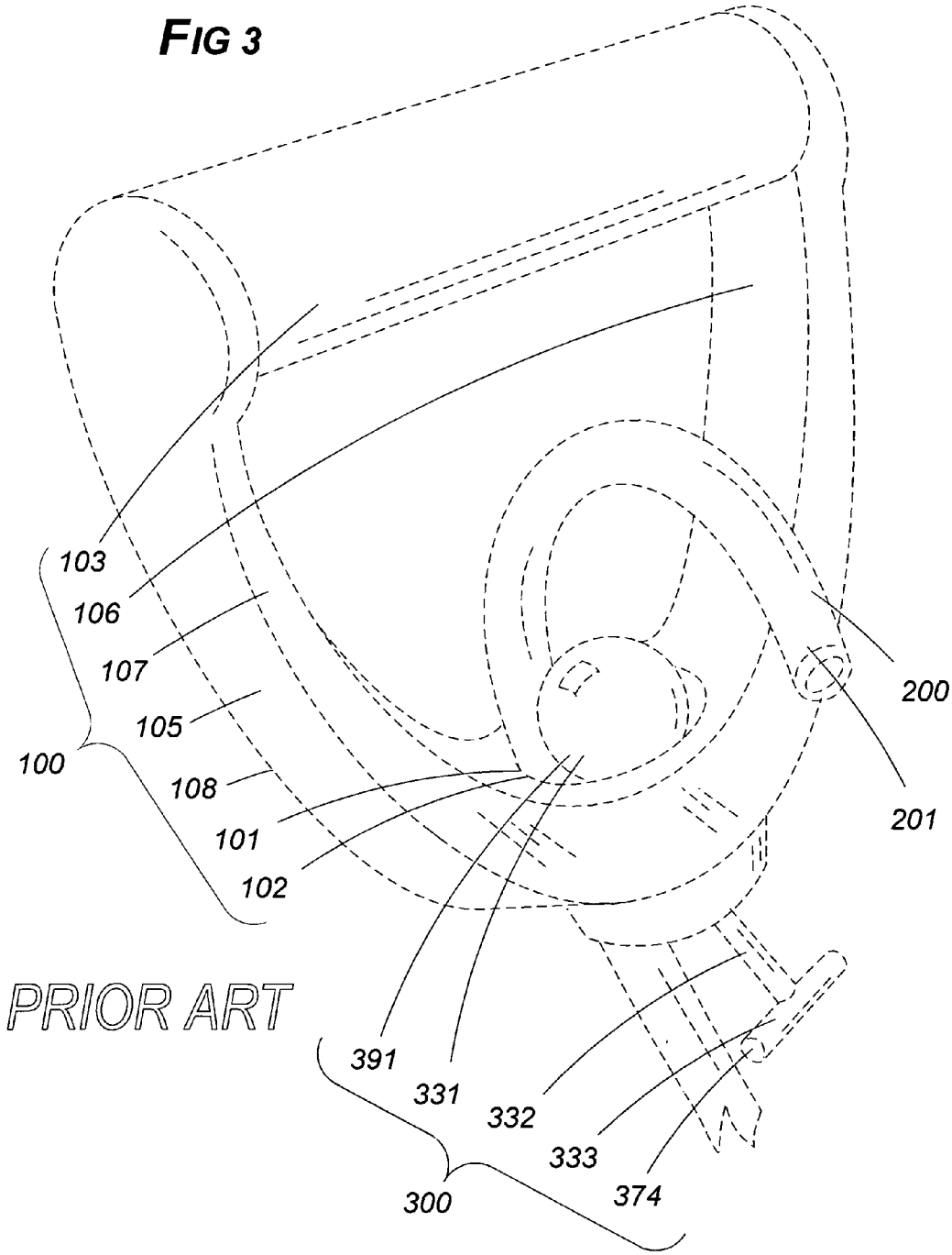
FIG. 3 portrays the tunneled stirrup handgrip (100) of prior art wherein the more familiar retention configured impinger (300), shown with the stem passing through the tunnel (101) comprises the well known rod-like transverse extension (374).
Figure 7:
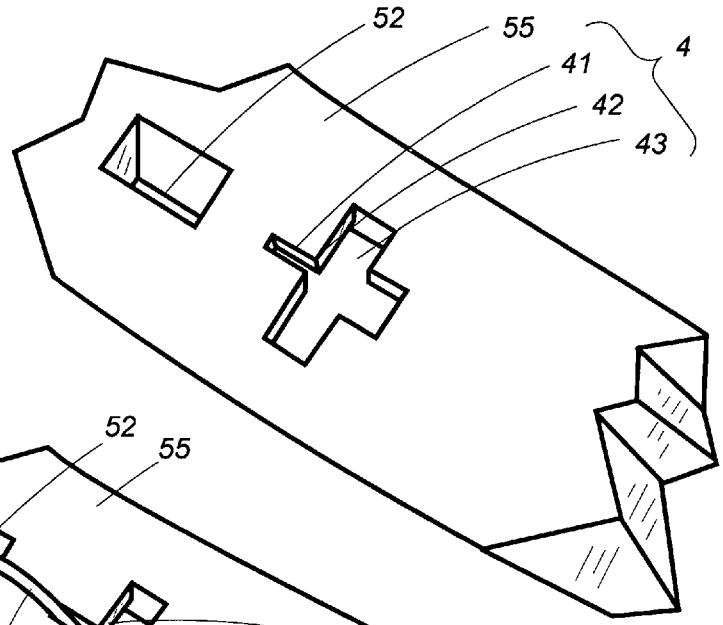
Figure 8:
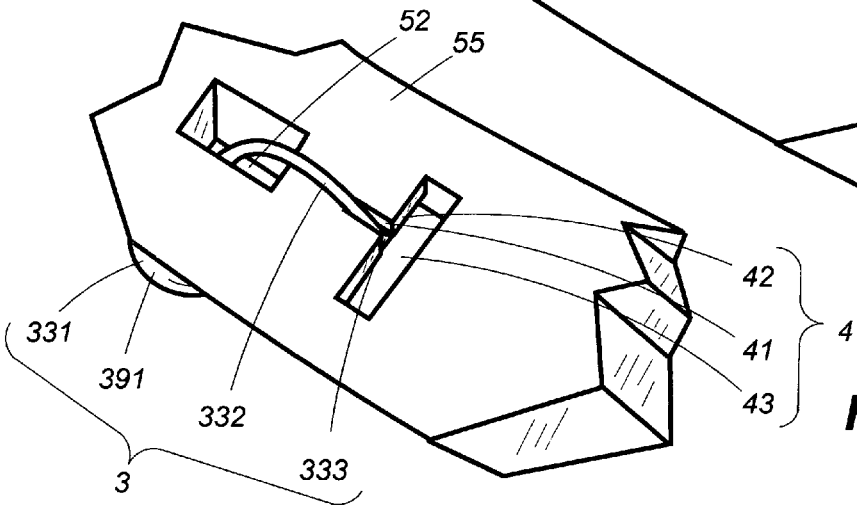
Figure 9:
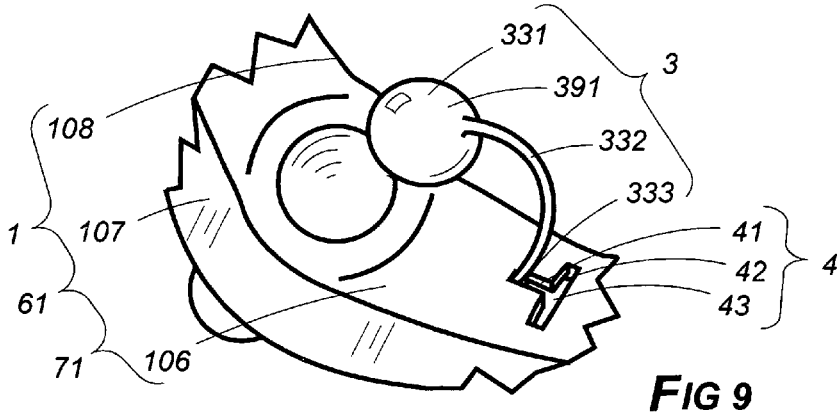
FIG. 9 is a cut-away view of an interior sector anchoring handgrip (61), an embodiment in which the retention channel (41) is disposed within the handgrip's interior sector (106). No tethering window (52) is, accordingly, required.
Figure 10:
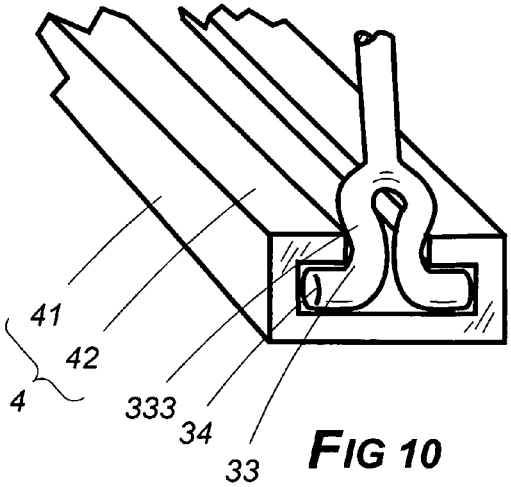
FIGS. 10 and 11 provide tether (33, 333) and channel (41) examples of peg or rod-like extension (34, 374) and transverse socket or aperture (46, 47) connective relationships. The first of those drawings illustrates the seating of the pegs (34) of the pinchable tether (33); the second thereof, the usual rod-like extensions (374) of the prior art tether model (333).
Figure 11:
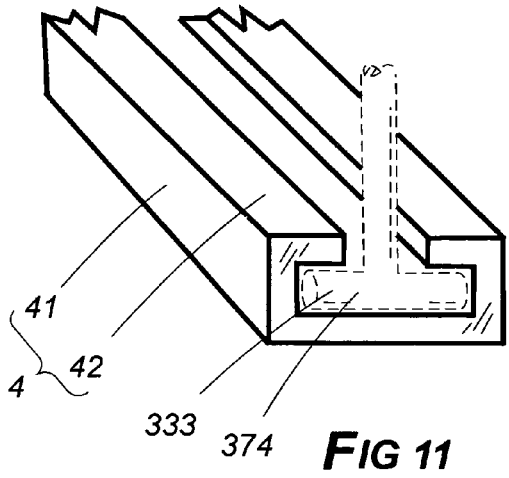
Figure 12:
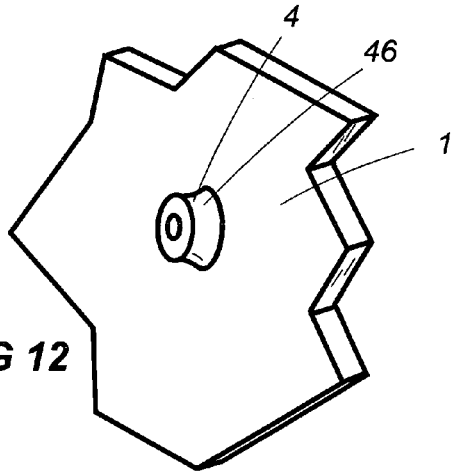
FIGS. 12 and 13 are cut-away portions within the ensconcing hollow (55) of tether pivot-anchoring means (4). The first of these displays a transverse peg socket (46); the second, a transverse peg aperture (47).
Figure 13:
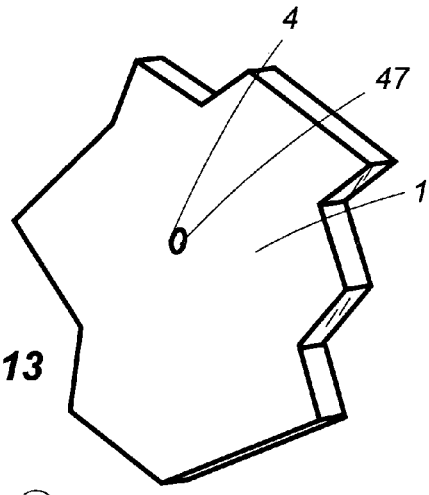
Figure 14:
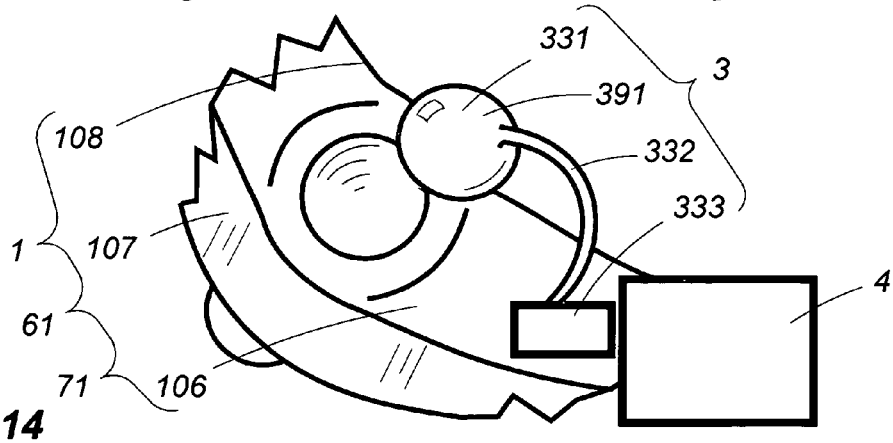
FIG. 14 illustrates the possibilities of incorporating any variant of generic or universal components for the impinger's tether (333) and its pivot-anchoring means (4). Thus, although this depiction bears some resemblance to FIG. 9, featuring an interior sector anchoring handgrip (61), it, nevertheless, differs substantially from it in offering anchoring capabilities at either the exterior or interior sector.
Figure 15:
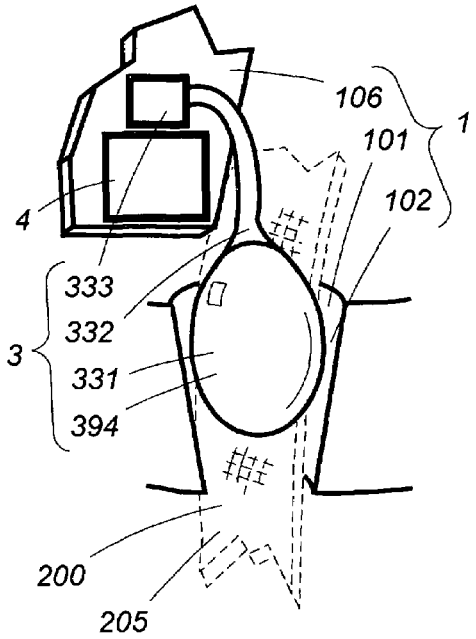
FIGS. 15-18 are cut-away views of various configurations of impinger heads (331) and also features options for alternative substitution of various components.
Figure 16:
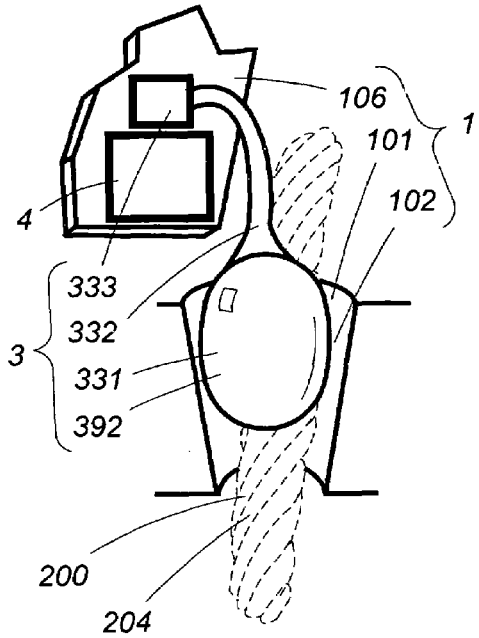
Figure 17:
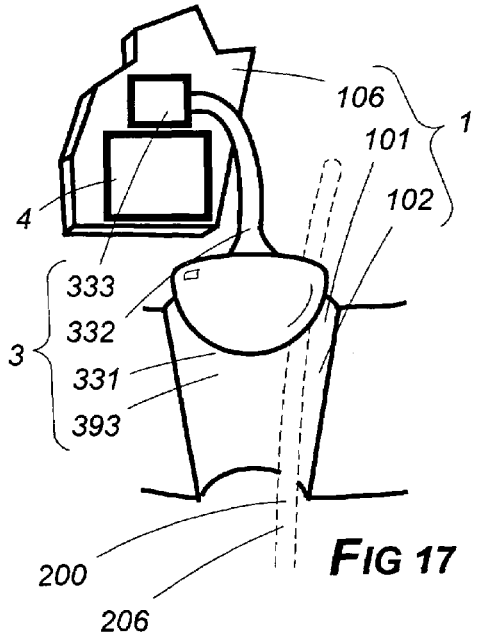
Figure 18:
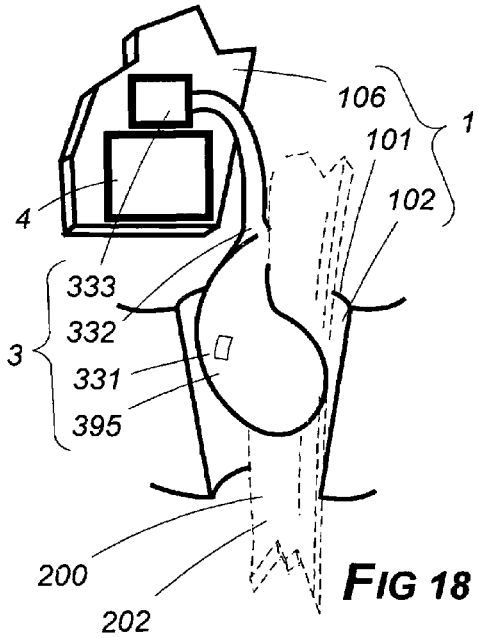
Figure 19:
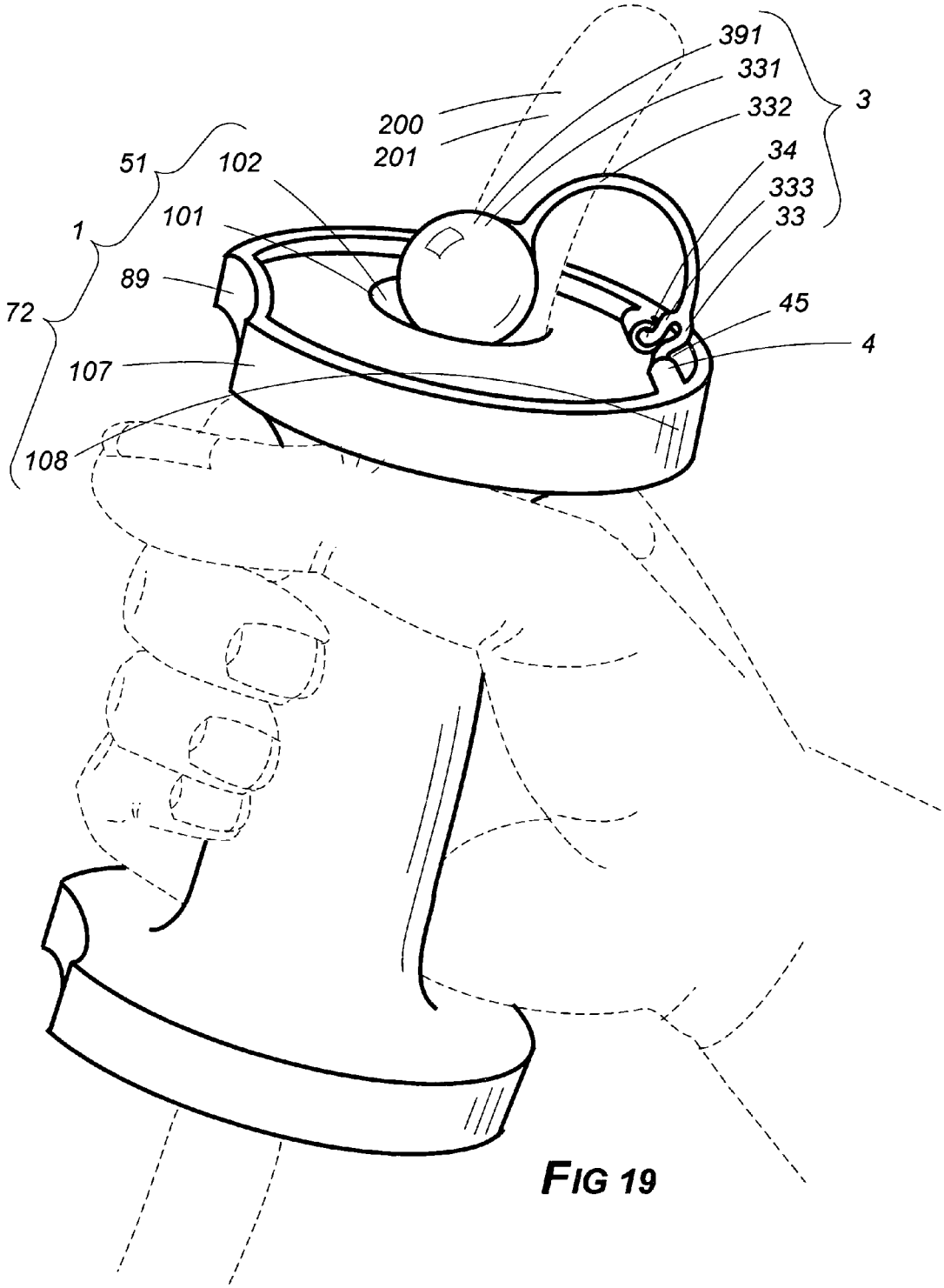
FIG. 19 represents in perspective an embodiment of the exercise spool grip (72) assembly illustrating an impinger's (3) engagement of stretchable cord (201). A pinchable tether (33) is shown anchored within a retention tunnel (45). The grip (72) is shown held upright similar to the manner ski poles would be used in cross-country skiing.
Figure 26:
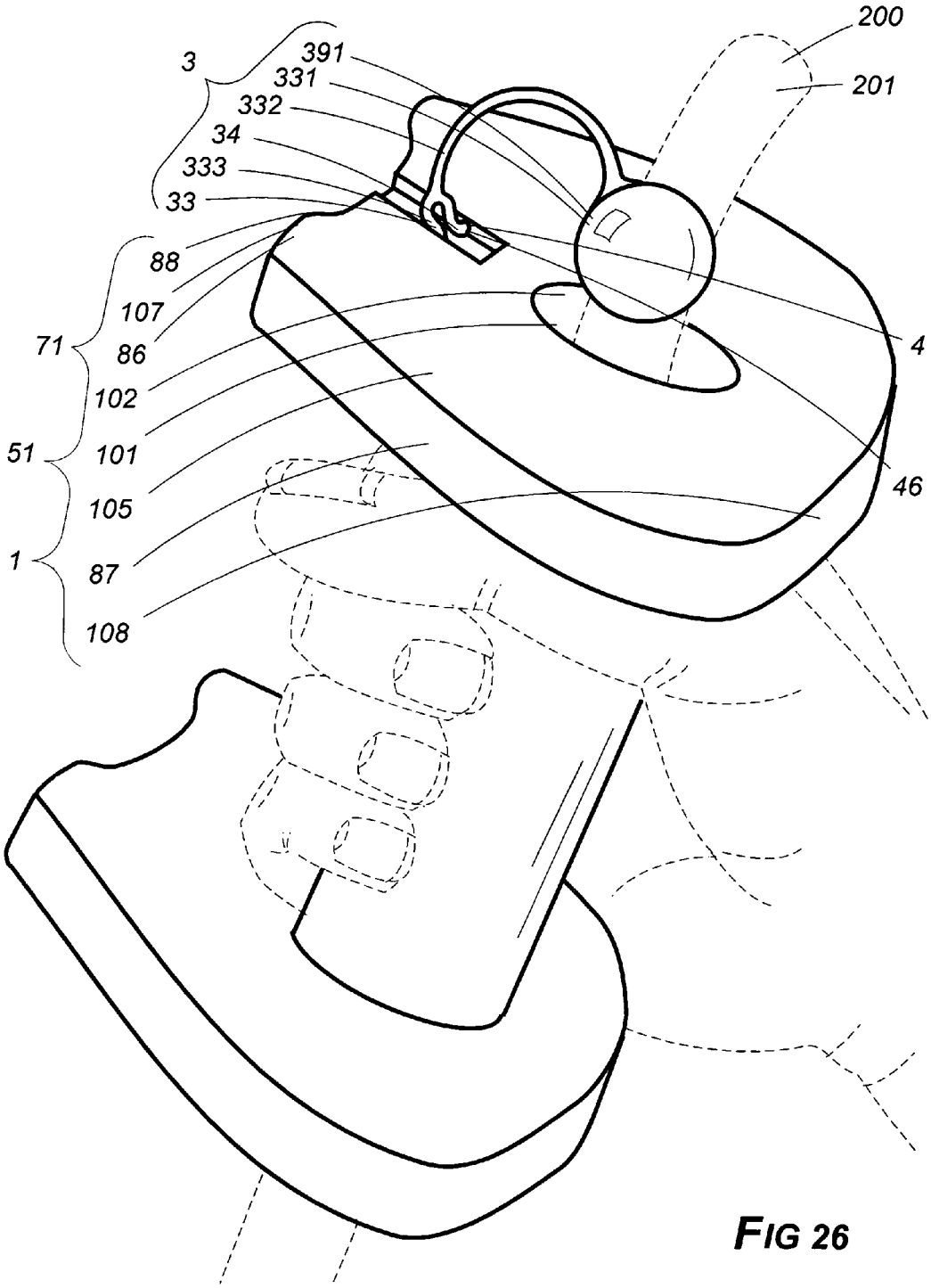
FIG. 26 represents in perspective a second embodiment of the exercise spool grip (72) assembly illustrating a preferred model differing in configuration from that shown in FIGS. 19-22. Stability studs (86) are shown in lieu of the stability groove (89), for example. The tether pivot-anchoring means is also shown moved toward the spool grip's face (107). Consistently, in FIGS. 27-29, traditional views are also shown as they were with the first embodiment.
Figure 27:
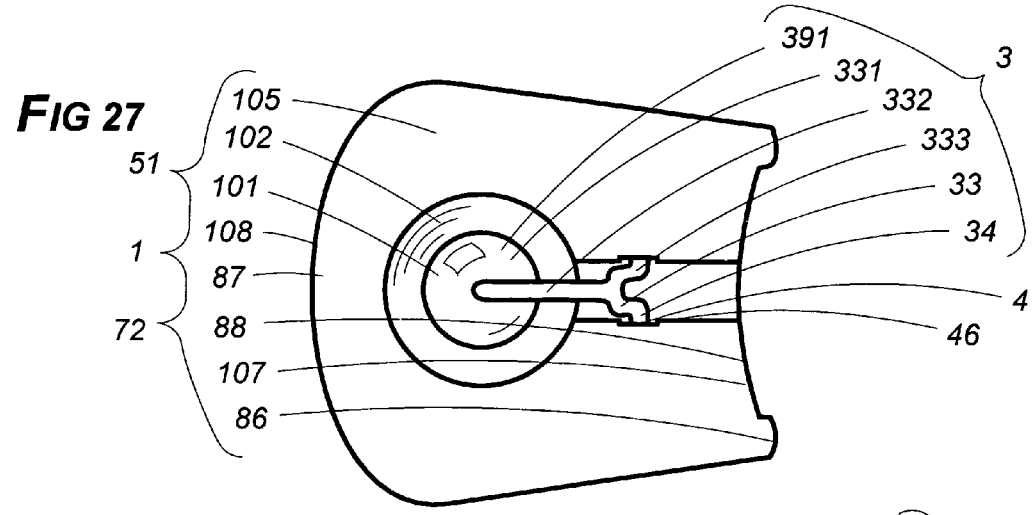
Figure 28:
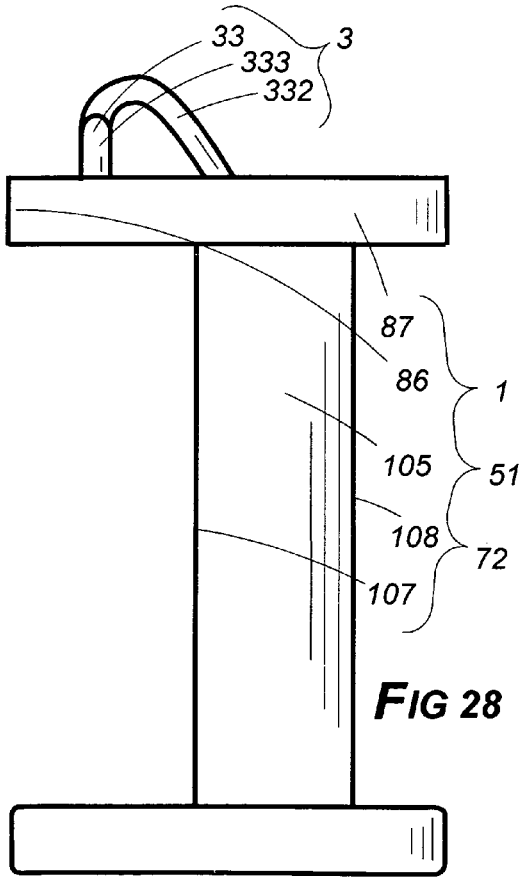
Figure 29:
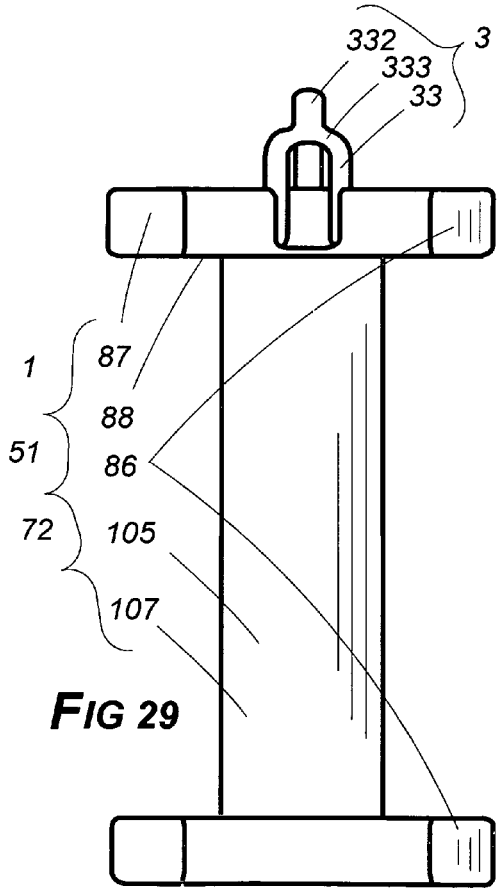
FIG. 29 comprises a face view, FIG. 30, a longitudinal cross section and FIG. 31, an upper view. The embodiment shown in FIG. 29 shows transverse peg apertures (47) for impinger (333) retention whereas that in FIG. 31 comprises a retention tunnel (45).
Figure 30:
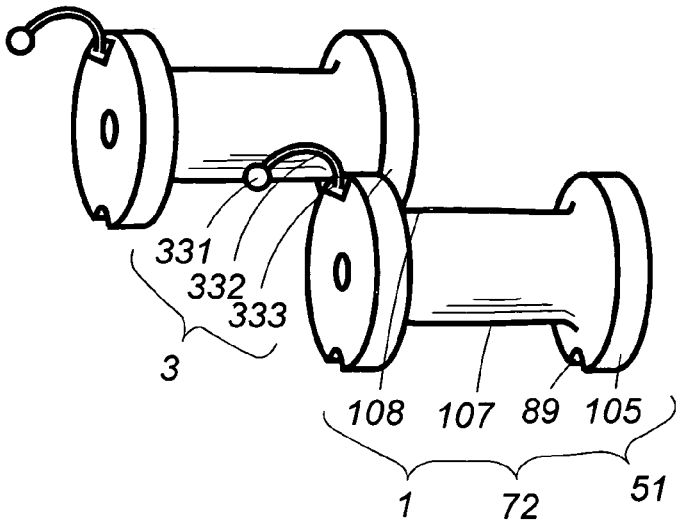
FIGS. 30-33 merely address exercises with the spool grip (72) other than in walking or cross-country like efforts.
Figure 31:
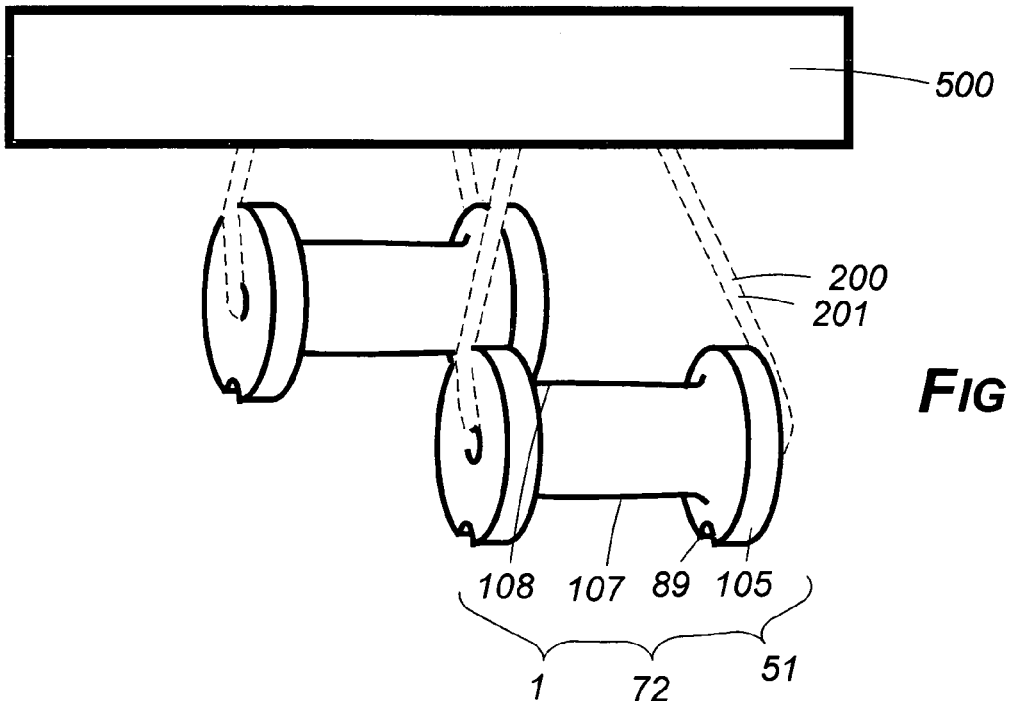
Figure 32:
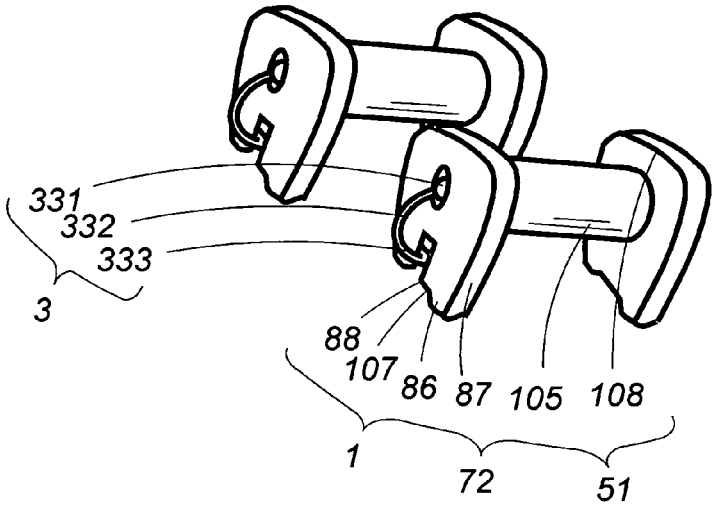
Figure 33:
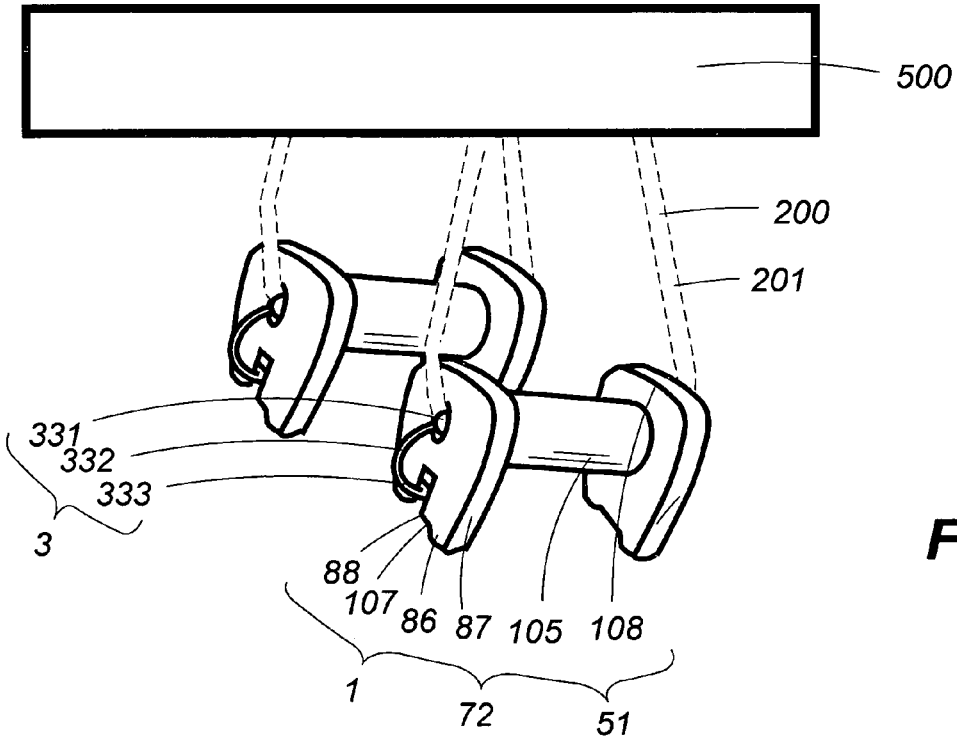
Figure 34:
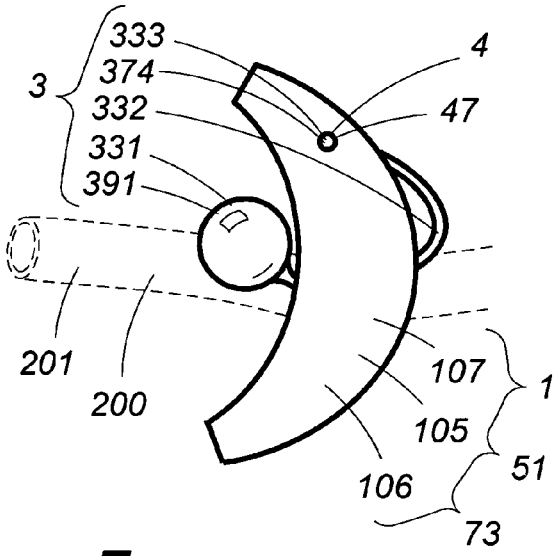
FIGS. 34-36 represent an embodiment of the impinger anchoring ankle grip (73) assembly.
Figure 35:
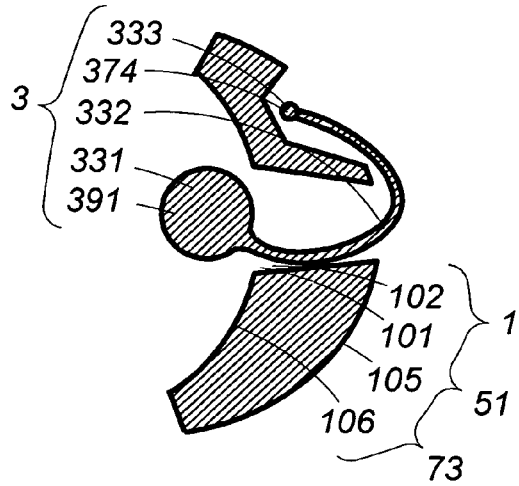
Figure 36:
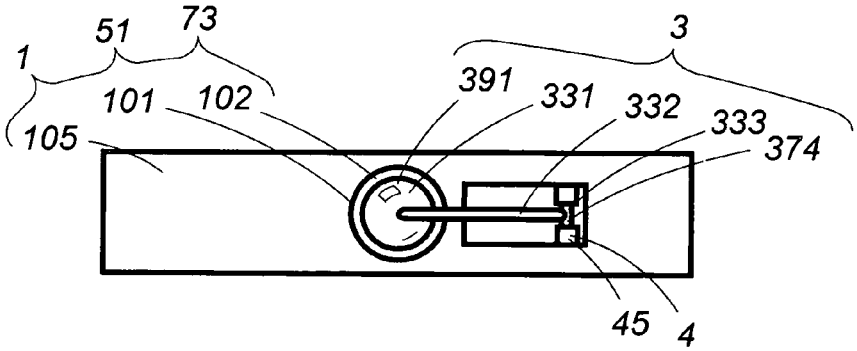

The subject matter of this application include embodiments comprising in the main two principal components—the first, any of three sorts of hand-held objects; the second, an object enlisted either with or without modification from the prior art to serve as a retention or impingement part of a combination. The variants, thus, are members of the same family—that is, of a generic impinged retention assembly, the subject matter hereof. They bear in common a number of features strongly related to one another in structure and function.

The two general components all three members of the generic family share comprise a given impinger anchoring exercise grip (1) and the impingement mechanism (3, 300). However, it is the manner those two (1; 3, 300) are interconnected which confers any real significance upon the assembly members. It is, accordingly, appropriate to consider at the outset those characteristics common to the family. Thereafter, the impinger anchoring handgrip (71), the impinger anchoring exercise spool (72) and the impinger anchoring ankle grip (73) are individually addressed.

All variants of the exercise grip (1) comprise a face (107), a reverse side (108) and an exterior sector (105). By reason of configuration, only two of those variants, ante, comprise an interior sector (106). All further comprise tether pivot-anchoring means (4) disposed within its (1) body and an exercise media tunnel (101) disposed and configured for enreevement by exercise media (200) for the performance of physical exercise. The tunnel (101) in turn comprises an impingement nest (102) wherein exercise media (200) used in conjunction with the exercise grip (1) is retained by impingement. In all of exercise arrangements, the media is caused to enter the tunnel from the grip's (1) non-impinged end.

The impinged retention assembly comprises in addition to the exercise grip (1) either of two sorts of impingers, each (3, 300) in turn comprising a head (331), a stem (332) and a tether (333). It is the impinger (3, 300), of course, which accomplishes the exercise media's (200) retention within the grip's tunnel (101). As addressed supra, the traditional sort of impinger (300) has passed to the prior art. It (300) remains useful as part of some combinations hereof, however. It (300) may be used interchangeably with a newer version offered herein (3) which differs from it (300) only in the configuration of its tether (33)—herein further designated with the adjective "pinchable", ante.

Although, as discussed supra, certain forms of exercise grips (1) operable in conjunction with impingers (300) are already known to us. The impinged retention assembly hereof, however, not only offers new configurations for the grip (1) but interconnects those components in particularly useful ways. In all variants of the grip (1), the impinger's tether is retained by anchoring within the body thereof (1). To that end, the grip (1), whatever its particular variant, comprises tether pivot-anchoring means (4), whereby the impinger's tether (333) is retained therein in a manner which allows it (333) to pivot freely. As the tether (333) pivots, of course, the entire impinger (3, 300) traces out an arcuate path, the curvature of which is predetermined so as to cause the impinger's head (331) to swing into the tunnel's impingement nest (102). For tether (333) anchoring purposes, It should be understood, of course, that the meaning of "within the body" of the grip (1) as a site for tether pivot-anchoring means (4) is that accorded it among the definitions set forth supra.

The impinger's head (331) may be configured in any one of a number of ways. While any of the prior art shapes comprising a circular cross-section will work satisfactorily, the spherical (391) is preferred.

By definition herein, the phrase impinger anchoring used as an adjective with reference to any variant of the exercise grip (1) means that the grip's (1) form is such as to provide an anchoring niche, appendage or other holding structure wherein the impinger's tether (33, 333), supra, is retained in a manner which enhances use of the combination in the respects addressed herein.

As its name suggests, an exterior anchoring type of impinged retention assembly (51) comprises one in which the impinger (3, 300) is anchored at the exercise grip's exterior sector (105).

The popular rod-like transverse extension (374) model of tether (333) may be acceptably employed in the assembly. Of the impingers (300) presently known, one (300) comprising a flexible stem (332) would facilitate manipulation for the tether's (333) and stem's (332) operative reeving through exercise grip (1) openings designed for that purpose. However, to address the issues of movement constraint just alluded to, experience dictates advantage and, accordingly, a preference first, by configuring the stem (332) and tether (333) to comprise what is defined herein as relative rigidity, wherein little or no bending is permitted to occur; second, by securely anchoring the tether (333), ante; and third, by disposing the handgrip's pivot-anchoring means (4) and the exercise grip's impingement nest (102) in communicative alignment with one another—defined to mean herein that the two (4, 102) are disposed in a fairly straight line.

In this construction, the operator may conveniently push the impinger (3, 300) into the handgrip's impingement nest (102) with his or her thumb, the projecting stem (332) behaving much like a trigger. It is the degree of rigidity conferred upon the impinger (3, 300) which makes this feasible. Moreover, because of the removal of the impinger's stem (332) from it (101), the exercise grip's tunnel (101) may be configured with greater diameter, enhancing the use of stretchable exercise sheet (203) as the media member (200), to meet the problem otherwise associated with that, supra.

In these arrangements, it is generally contemplated that a tether's (33, 333) retention is accomplished during manufacture. Techniques are even known, though not perhaps preferred, by which the tether (33, 333) could be factored within the assembly in a manner suggestive of the well known ship-in-a-bottle exhibit. However, were the two members of the assembly—the specially configured exercise grip (1) and the impinger (3, 300)—separately provided, they (1; 3, 300) can be operably snapped together in preparation for exercise if suitable allowances are made for doing so.

Even if the tether (33, 333) comprises configuration of a different sort wherein pegs (34) or lateral extensions (374) are absent, any intermediate passage-way for it should, nonetheless, be configured to accommodate its (33, 333) narrowest dimension.

However, it is highly advantageous to incorporate the rod-like structures of the prior art (374) or those of opposing peg configuration provided for herein (34) because they (374, 34, respectively) may be fitted into transverse peg sockets (46) or transverse peg apertures (47). As the name suggests, the peg sockets (46) are receptacles disposed in opposition within the body of the exercise grip (1) so that the pegged or rodded portions (34, 374) of the tether structures (33, 333) are seated within them (46) in what is herein designated pivot-retention. So disposed, the inserted pegs (34) are free to pivot but by reason of the tether's (33, 333) configuration, are retained securely in place much as a vehicle's axle would be within its housing. Peg apertures (47), if present in substitution for the sockets (46) function in the same manner as them (46). As a convenience in manufacture, the apertures (47) may be drilled—or tunneled—completely through the body of this type of exercise grip (1). Although apertures (47) are employed, a socket-like ridge built up around them (47) may be provided such that pivot-retention of the pegs (34) or extensions (374) is reinforced.

The rod-like transverse extensions (374), when comprised by the prior art tether (333) have been observed to provide enough flexibility to permit their (374) being forced into place. Preferably, however, the assembly hereof comprises the pinchable tether (33) referred to supra as tether retention means or tether pivot-retention configuration. The pinchable tether (33) is particularly well suited to both installation and retention in that the open extensions of its U-shape may be pinched together and then released to slip the pegged ends (34) through any retention channel (41) or other intermediate passage-way present and fit into place within the transverse peg sockets (46) or apertures (47). Experience suggests a preference in tapering the walls of any intermediate passage-way for an impinger's stem (332) directed toward the tunnel's impingement nest (102) such that they are wider at the interior sector (106) than at the exterior one (105). Such configuration enhances enreevement of the tether (33, 333) therethrough. The pinchable tether's (33) installation is also benefited by the preferred communicative alignment described supra. The connection is an appropriate example of rigid emplacement as defined herein, supra. It is for all these reasons these pegged (34) or rodded (374) structures are preferred embodiments of tether (331) design and sockets (46) and apertures (47), preferred tether pivot-anchoring means (4).

In a some embodiments, the exercise grip (1) comprises a retention channel (41)—a trench configured to comprise the tether pivot-anchoring means (4). Retention is enhanced by narrowing a portion of the channel (41) so that the tether (333) becomes wedged within it (41) when tugged. Preferably, the channel itself (41) is formed to comprise a stem slotted roof (42), disposing the cross-sectional opening into a generalized inverted T-shape, resembling the well known strain relief provided on some electronic equipment to keep an electric cord from pulling loose.

In this channeled embodiment, the pegged (34) or rod-like (374) portions of the tether (33, 333) are permitted to slide freely along the channel (41) beneath its roof (42), but cannot easily be removed from this captive enclosure. As with their seating in the socketed (46) or apertured (47) constructions, they (34, 374), again, are appropriately said to be rigidly emplaced. As suggested, supra, the slotted roof (42), when present, is preferably configured to provide a tether access opening (43).

In all of the exterior sectored (105) anchoring schemes, as preferentially indicated, supra, the tether pivot-anchoring means (4) and the tunnel's impingement nest (102), together with any intermediate passage-ways, are preferably disposed, of course, in communicative alignment. However, even more than that is required to insure maximum operability.

The center of the impinger head's (331) horizontal cross-section—that is, the circular cross-section one would observe if peering downward through the handgrip's tunnel (101) at it (331) seated at the nest (102) therein (101)—is preferably disposed or aligned with the longitudinal center of the tunnel itself (101), in disposition of what is herein defined as radially centered alignment. Now, as the head (331) is moved from its (331) dormant non-impinging position to its (331) fully impinging one, it (331) traces out or describes a circularly arcuate path of descent. The tether pivot-anchoring means (4), whether the point of restraint within a retention channel (41) or the horizontally disposed axial center of the transversely disposed tethering means (34, 374), thus, occupies the circle's center in this preferable arrangement. Should those points be off-center, it is likely the impinger's head (331), extending from a reasonably stem (332) comprising little flexibility, would butt up against the sides of the vertically disposed handgrip tunnel (101) as it (331) moves either upwards or downwards therethrough (101).

Moreover, even having assured the presence of radially centered alignment, supra. It is further preferable to provide a tunnel (101) for the exercise grip (1) which is wider at the top thereof (101) than at the bottom or—in any event—than the impingement nest (102).

In considering these preferential steps, a further measure should also be taken: The axial center of the transversely disposed extensions (374) or pegs (34) should be in approximate horizontal alignment with the point of impingement—that is, the point at which the impinger's head (331) has reached full impingement of any exercise media (200) present or, if none is present, the point at which it (331) fully engages the impingement nest (102) within the tunnel (101). This disposition of tether (333) and head (331) is herein described as horizontally aligned head to tether centering. If out of such preferred horizontal alignment, the impinger head's (331) arcuate path would again likely bring it (331) in contact with the tunnel's (101) wall, impeding impingement or contributing to potential impinger head (331) or tunnel (100) abrasion.

The issues of side-to-side swaying, stress torque and other divergent movements of the impinger's head (331) mentioned supra, are addressed in either of the exterior sector anchoring handgrip (51) embodiments hereof in two general ways. First, the impinger's tether (33, 373) is securely anchored. Second, the composition of the improved impinger (3) herein or its prior art predecessor (300) must be such as to comprise either of them (3, 300) with considerable stiffness-a property herein designated as relative rigidity. Thus, both a prior art impinger (300) having a stem (332) comprising that property and the improved impinger hereof (3), which is required to comprise it, are thereby distinguished from the less preferred prior art impinger (300) comprising flexibility depriving it (300) of that quality. The steps taken to address tether (33, 333) security and impinger (3, 300) composition—the two measures addressed supra—provide a property herein defined as axial stability.

Whether tether pivot-anchoring means (4) is accomplished by disposing members of the impinger (3, 300) into sockets (46) or apertures (47), or whether into a retention channel (41), the impinger's stem (332) is made to comprise composition providing it (332) relative rigidity and curved configuration so that it (332) is disposed to extend upward and then to curve downward. During impingement—that is, when the head (331) is seated against the exercise media member (200) within the tunnel nest (102), the stem (332) is disposed to pass through any intervening passage-ways without contact between them. When during non-impingement, the impinged retention assembly (1) is held so that its tunnel (101) is disposed downward, the impinger (33, 333) is drawn out of the way by gravity.

The first of the family of assembly member variants is derived, but only in part, from a prior art counterpart. To this end, the tunneled stirrup handgrip (100) therefrom is modified in certain particulars to comprise what is referred to herein as an impinger anchoring handgrip (71) comprising in addition to a face, reverse side and exterior sector (107, 108, 105, respectively), an interior sector (106). This embodiment (71) permits the anchored connection of an impinger either of the prior art variety (300) or the one provided anew herein (3). The connection can then be made in a manner which, in two of the arrangements presented herein, renders the impinged retention assembly's cord tunnel (101) unobstructed by any portions of the impinger's stem (332) or tether, whether one known in general to prior art (333) or the one provided for herein as an improvement (33).

The handgrip (71) may be configured either as an exterior sector anchoring embodiment (51) or one comprising interior sector anchoring (61). In the exterior anchoring arrangement (51), a tethering window (52) is provided preferably configured as a slot passing through some portion of one of the grip's (51, 71) prongs or upward extensions. In assembly for use, the impinger's stem (332) extends through the window (52), disposing its tether (33, 333) at the grip's exterior sector (105) and its head (331) within the grip's interior sector (106). The structural relationships—the stem's (332) length and window's (52) proximity—allows the head (331) to reach the handgrip's impingement nest (102) within the cord tunnel (101).

Where anchoring comprises nothing more than disposing the tether (333) at the handgrip's exterior sector in such fashion that when tugged, it (333) is drawn against the window (52) to accomplish its (333) purpose and, perhaps, avoid loss, it (333) must comprise size sufficient to prevent its being drawn through the window (52). In this simple arrangement, the head (331), unfortunately, is in no way restrained from side-to-side swaying, stress torque when in use or from other unwanted movement even though so anchored by the tether (333). Despite the simplicity of this arrangement, the tether (333) may, nevertheless, be considered to comprise what is stated herein as tether retention means and the handgrip (51) to comprise tether pivot-anchoring means (4). However, other more preferable embodiments dedicated to those concerns are provided for herein, ante.

The exterior sector anchoring handgrip (51) comprises tether pivot-anchoring means (4) disposed at the exterior sector (105) upon one of the handgrip's (51) prongs. If a tether access opening (54) is disposed in the window (52), comprising a cutout of either T-shaped or cross-like configuration, either the lateral extension of the rod-like tether (374) or the pegs (34) of the pinchable tether (33) may be pushed through it (54). Once that has been done, the tether (333, 33) may be considered securely retained at the handgrip's exterior sector (105), exemplifying acceptable pivot-anchoring means (4). If there is provided thereat an ensconcing hollow (15)—a carved out portion of the exterior sector (105)—the tether (33, 333) will likely be open to view only upon very close scrutiny, depending mainly upon the hollow's (15) design. Tethers (33, 333) comprising either the traditional rod-like transverse extensions (374) or the pegs (34) for the pinchable tether (33) are herein defined to comprise retention means and alternatively described as those configured for retention or as comprising impinger retention means or as retention configured tethers (33, 333).

In the event pegs (34) or lateral extensions (374) are absent from the handgrip's tether (33, 333), the handgrip's tether access opening (54) should be configured, for purposes of installation, to accommodate its (33, 333) narrowest dimension.

As with all other members of the exercise grip family (1), the handgrip (71), too, may comprise, disposed upon one of its (71) prongs, a retention channel (41), supra. In the exterior sectored embodiment (51), the channel's (41) disposition is proximate the necessarily present window (52) at the exterior sector (105). The inverted T-shaped configuration of the tether access opening (43) should not be confused with the perimeter of the similarly designed optional T-shaped perimeter of any window access opening (54) present.

In these arrangements, the channel (41) and window (52), through which the curved stem (332) passes, are preferably disposed in communication with one another (41, 52), since such configuration permits the stem (332) to seat more completely within the channel (41) without outward projection during impingement. Moreover, the tethering window (52), when present, is preferably disposed in communicative alignment with the tether pivot-anchoring means (4) and the tunnel's impingement nest (102).

In the interior sector anchoring handgrip (71, 61)—a less preferred but, nevertheless, workable embodiment—no window (52) is present. Instead, only the retention channel (41)—or alternatively, a retention tunnel (45)—is employed. In this embodiment, the tether pivot-anchoring means (4) is again disposed upon one of the handgrip (71, 61) prongs, but now within the interior sector (106). The tether (333) is constrained at the channel's roof (42)—so that both the benefit of communicative alignment during impingement and that of gravity effected displacement during times of non-impingement are advantageously addressed. It has been observed that anchoring at an exterior sector (105) is more conducive to that end than anchoring at an interior sector (106).

The exterior anchoring handgrip (51) preferably comprises a further useful modification. It (51) may have carved into its exterior sector (105) the ensconcing hollow (55) referred to supra-a shaped cavity wherein the impinger pivot-anchoring means (4) are embedded in a manner which removes the means (4) substantially from view, streamlining the handgrip's (51) shape for both functional and aesthetic reasons. To that end, peg sockets (46) or peg apertures (47) may be disposed upon the interior walls of the ensconcing hollow's (55) interior walls.

The second member of the family of exercise grip (1) variants is an assembly incorporating the impinger anchoring exercise spool (72), deriving its name from the flanged cylindrical shape it preferably comprises. It, too, comprises a face (107), reverse side (108) and exterior sector (105) but by reason of configuration, no internal sector (106). The hand-held spool (72) is used in pairs in the manner one would use ski poles in cross-country skiing. Preferably, as grip-friendly ergonomic features, it (72) comprises a perimeter flange (87) at its (72) upper and lower extremes and may additionally comprise a slightly convex exterior between them (87). a suitable exercise tensioning anchor (500) is provided for the exercise media's (200) connection. As with the handgrip (71), it is the exercise media (200) which provides the beneficial resistance.

In performing cross-country skiing or walking type exercises, the media's (200) source of tensioned anchoring may be provided by connecting it (200) to the operator's feet or legs. Beneficial variations in tension restrained leg and arm movements may then be undertaken as desired by the operator. Tensioned anchoring may be derived from a wall or door mount, however, in which case, a number of different but, perhaps, equally beneficial variations in movement may be selectively employed.

It is readily observed that the same principles applicable to the other exercise grip (1) members function similarly here. There are, for example, the same concerns for alignment and rigidity as those considered for them. The spool's impinger tether pivot-anchoring means (4) disposed atop the structure are also the same in the functional sense.

To accommodate the performance of exercises other than those associated with walking or cross-country skiing, it is preferred that the spool grip (72) be configured so that its (72) face (107) is partly squared off or flattened inward—comprising what is herein designated a stabilizing sector (88)—and that either stability grooves (89) or stability studs (86) be formed thereat (107) within or upon the grip's flanges (87) at its (72) upper and lower extremes. These configurations provide an acceptable base for emplacement upon the floor or other underlying surface for the performance of pushups and related exercises without the addition of exercise media (200). Optionally, the operator may reeve the media (200) through the grip's tunnel (101) and connect the ends thereof (200) to any acceptable anchoring point, herein designated an exercise tensioning anchor (500). The operator's own body may provide the anchor (500) to engage the sought-after exercise resistance by allowing media (200) either to interconnect with a harness or belt or by stretching the media (200) and passing it (200) over the shoulders. Alternatively, the media (200) may be extended to a wall or door mount or to any other fixed object acceptable as a tensioning anchor (500).

The third member of the family of exercise grip (1) variants is an assembly incorporating the impinger anchoring ankle crescent grip (73), comprising form-fitting configuration for one's ankle. It (73) derives it name from its generally modified (73) quarter-moon shape, more technically referred to as converging concavo-convex, or converging meniscus in shape. The modification is a preferable aspect, comprising nipped off or truncated ends for the sake of safety and aesthetics.

Like the handgrip (71), the ankle crescent grip (73) comprises a face (107), reverse side (108) and exterior and interior sectors (105, 106). Used in ankle connecting pairs, the grip (73) enables the performance of lateral leg extension repetitions. The impinger's head (331) passes through its tunnel (101) to engage the exercise media (200) in impingement and is then pulled back into the tunnel's impingement nest (102). It (73) actually may be considered to bear even a closer resemblance to the handgrip (71) in appearing to comprise the lower part of a severed-off exterior sector anchoring model (51). Closer examination, however, reveals that the crescent grip (73) comprises no tethering window (52) and that its (73) tether pivot-anchoring means (4) is actually reversed from that of the grip suggested for comparison (51).

Thus, the impinger's (3) entry into the crescent grip's (73) tunnel is from its exterior sector (105), rather than from its interior one (106) as in the usual case. And so it must be, since if tether pivot-anchoring were disposed at the interior sector (106), media (200) length—and consequently exercise resistance—could not be adjusted without removing the grip (73). Once the grip (73) is installed upon the operator's ankle, there is no space between the concave interior sector and the ankle for impinger (73) operation or adjustment. Moreover, protrusion of portions of the stem at the interior sector (106) could injure or at least become a likely source of discomfort to the operator. So long as the means of tether pivot-anchoring (4) is disposed at the grip's exterior sector (105), adjustment may be conveniently undertaken as desired.

The ankle crescent grip (73) comprises the only member of the exercise grip family (1) wherein the impinger (333) is directed toward and into the tunnel's impingement nest (102) directly from the grip's exterior sector (105). It (73), nonetheless, comprises an acceptable member of this group (1) in sharing with the others (71, 72) the novelty of tether pivot-anchoring means (4) disposed within the grip's (73) body. It (72) is generally connected to fabric strapping or other similar material which enwraps the ankle for interconnection at miniature hook and loop patchwork during use.

The invention claimed is:

1. An impinged retention exercise assembly comprising:
an impinger for an exercise media member; and
an impinger anchoring exercise grip;
the impinger comprising
a head;
a stem; and
a tether in turn comprising means of pivot-retention;
the exercise grip comprising an exercise handgrip further comprising
a handhold as a part thereof;
a face, reverse side, interior sector and exterior sector; and
an exercise media tunnel disposed and configured for enreevement by exercise media for the performance of physical exercise, the tunnel in turn comprising an impingement nest;
the exercise grip further comprising
tether pivot-anchoring means disposed within its body at the grip's interior sector;
wherein the tether is disposed for pivot-retention with the impinger's stem extending within the handgrip such that the exercise media member's impingement by the head is not subjected to compromise by reason of obstructive presence of the stem or tether within the handgrip's tunnel.

2. The impinged retention exercise assembly according to claim 1 wherein
the impinger's head, impinger's stem and the handgrip's tunnel are disposed in communicative alignment;
the impinger's head and handgrip's tunnel are disposed in radially centered alignment;
the impinger comprises horizontally aligned head to tether centering; and
the impinger's stem is configured to comprise relative rigidity providing the impinger axial stability.

3. The impinged retention exercise assembly according to claim 1 wherein the impinger tether's means of pivot-retention comprise one of
pinchable tether pegs; and
rod-like transverse extensions;
and the handgrip's tether pivot-anchoring means disposed at the handgrip's interior sector comprises one of
a retention channel; and
a retention tunnel.

4. The impinged retention exercise assembly according to claim 3 wherein the tether pivot-anchoring means comprises a retention channel in turn comprising a narrowed sector.

5. An impinged retention exercise assembly comprising:
an impinger for an exercise media member; and
an impinger anchoring exercise grip;
the impinger comprising
a head;
a stem; and
a tether in turn comprising means of pivot-retention;
the exercise grip comprising a hand-held exercise spool grip further comprising
a face, reverse side and exterior sector; and
an exercise media tunnel disposed and configured for enreevement by exercise media for the performance of physical exercise, the tunnel in turn comprising an impingement nest;
the exercise spool grip further comprising
tether pivot-anchoring means disposed within its body at the grip's exterior sector;
wherein the tether is disposed for pivot-retention with the impinger's stem extending such that the exercise media member's impingement by the head is not subjected to compromise by reason of obstructive presence of the stem or tether within the handgrip's tunnel.

6. The impinged retention exercise assembly according to claim 5 wherein the impinger's head, impinger's stem and the exercise spool grip's tunnel are disposed in communicative alignment;

the impinger's head and exercise spool grip's tunnel are disposed in radially centered alignment;

the impinger comprises horizontally aligned head to tether centering; and the impinger's stem is configured to comprise relative rigidity providing the impinger axial stability.

7. The impinged retention exercise assembly according to claim 5 wherein the impinger tether's means of pivot-retention comprise one of pinchable tether pegs; and rod-like transverse extensions;

and the exercise spool grip's tether pivot-anchoring means disposed at the exercise spool grip's exterior sector comprises one of a retention channel; and a retention tunnel.

8. The impinged retention exercise assembly according to claim 7 wherein the tether pivot-anchoring means comprises a retention channel in turn comprising a narrowed sector.

9. An impinged retention exercise assembly comprising:

an impinger for an exercise media member; and an impinger anchoring exercise grip;

the impinger comprising a head;

a stem; and a tether in turn comprising means of pivot-retention;

the exercise grip comprising an ankle crescent exercise grip in turn comprising an interior sector generally concave in configuration;

wherein the ankle crescent exercise grip's exterior sector comprises generally convex configuration; the ankle crescent exercise grip further comprising a face, reverse side and exterior sector; and an exercise media tunnel disposed and configured for enreevement by exercise media for the performance of physical exercise, the tunnel in turn comprising an impingement nest;

the exercise grip further comprising tether pivot-anchoring means disposed within its body at the grip's exterior sector;

wherein the tether is disposed for pivot-retention with the impinger's stem extending with the impinger's stem extending through the exercise media tunnel therefrom such that the impinger's head is operatively caused to engage the exercise media within the tunnel's impingement nest for performance of exercise.

10. The impinged retention exercise assembly according to claim 9 wherein the impinger's head, impinger's stem and the ankle crescent exercise grip's tunnel are disposed in communicative alignment;

the impinger's head and ankle crescent exercise grip's tunnel are disposed in radially centered alignment;

the impinger comprises horizontally aligned head to tether centering; and the impinger's stem is configured to comprise relative rigidity providing the impinger axial stability.

11. The impinged retention exercise assembly according to claim 9 wherein the impinger tether's means of pivot-retention comprise one of pinchable tether pegs; and rod-like transverse extensions;

and the ankle crescent exercise grip's tether pivot-anchoring means disposed at the ankle crescent exercise grip's exterior sector comprises one of a retention channel; and a retention tunnel.

12. The impinged retention exercise assembly according to claim 11 wherein the tether pivot-anchoring means comprises a retention channel in turn comprising a narrowed sector.

13. The impinged retention exercise assembly according to claim 5 additionally comprising opposing perimeter flanges and the exercise spool grip's face is configured to comprise a stabilizing sector such that there is disposed within or upon the flanges one of a stabilization groove; and a stability stud;

whereby the spool grip's paired use in performing pushup type exercises with or without the incorporation of exercise media is enhanced.

14. The impinged retention exercise assembly according to claim 9 comprising truncated ends;

wherein the ankle crescent exercise grip's safety in use and aesthetics are enhanced.

* * * * *